US011122862B2

(12) United States Patent
Uesato

(10) Patent No.: US 11,122,862 B2
(45) Date of Patent: Sep. 21, 2021

(54) ARTICLE OF FOOTWEAR INCORPORATING A CURVED KNITTED LACING ELEMENT

(71) Applicant: NIKE, Inc., Beaverton, OR (US)

(72) Inventor: Lia Uesato, Beaverton, OR (US)

(73) Assignee: NIKE, INC., Beaverton, OR (US)

( * ) Notice: Subject to any disclaimer, the term of this patent is extended or adjusted under 35 U.S.C. 154(b) by 261 days.

(21) Appl. No.: 16/376,900

(22) Filed: Apr. 5, 2019

(65) Prior Publication Data

US 2019/0231030 A1 Aug. 1, 2019

Related U.S. Application Data

(63) Continuation of application No. 15/156,044, filed on May 16, 2016, now Pat. No. 10,294,592.

(60) Provisional application No. 62/162,305, filed on May 15, 2015.

(51) Int. Cl.

| | |
|---|---|
| ***D04B 1/10*** | (2006.01) |
| ***A43B 23/02*** | (2006.01) |
| ***A43C 1/04*** | (2006.01) |
| ***A43B 1/04*** | (2006.01) |
| ***A43B 7/06*** | (2006.01) |

(Continued)

(52) U.S. Cl.

CPC ..... *A43B 23/0205* (2013.01); *A43B 1/04* (2013.01); *A43B 7/06* (2013.01); *A43B 7/34* (2013.01); *A43B 23/0265* (2013.01); *A43C 1/04* (2013.01); *D04B 1/104* (2013.01); *D04B 1/22* (2013.01); *D10B 2403/0311* (2013.01); *D10B 2501/062* (2013.01)

(58) Field of Classification Search

CPC .. D04B 1/22; D04B 1/104; D04B 1/24; A43B 1/04

See application file for complete search history.

(56) References Cited

U.S. PATENT DOCUMENTS

| | | | |
|---|---|---|---|
| 1,185,933 | A | 6/1916 | Powell |
| 2,403,201 | A | 7/1946 | Wildt et al. |
| 2,657,561 | A | 11/1953 | Saunders et al. |

(Continued)

FOREIGN PATENT DOCUMENTS

| | | | |
|---|---|---|---|
| CN | 2438733 | Y | 7/2001 |
| CN | 103829460 | A | 6/2014 |

(Continued)

OTHER PUBLICATIONS

International Search Report and Written Opinion for International Application No. PCT/US2016/032724, dated Sep. 6, 2016, 13 pages.

(Continued)

*Primary Examiner* — Danny Worrell

(74) *Attorney, Agent, or Firm* — Shook, Hardy & Bacon L.L.P.

(57) ABSTRACT

A knitted component may include a boundary, a first course extending from the boundary, and a second course extending from the boundary. The first course and the second course may be interlooped at a first location, the first location being adjacent to the boundary. A contour section may be located between the first course and the second course at a second location, and the second location may be spaced from the boundary such that the boundary is curved in a concave manner at the first location.

20 Claims, 18 Drawing Sheets

(51) Int. Cl.
*A43B 7/34* (2006.01)
*D04B 1/22* (2006.01)

(56) References Cited

U.S. PATENT DOCUMENTS

| | | | | |
|---|---|---|---|---|
| 4,838,045 | A | 6/1989 | Cournoyer et al. | |
| 4,941,331 | A | 7/1990 | Cournoyer et al. | |
| 6,871,515 | B1 | 3/2005 | Starbuck et al. | |
| 8,839,532 | B2 | 9/2014 | Huffa et al. | |
| 9,032,763 | B2 | 5/2015 | Meir et al. | |
| 9,732,451 | B2 | 8/2017 | Lee et al. | |
| 10,294,592 | B2 * | 5/2019 | Uesato ..... | A43B 23/0265 |
| 2008/0110048 | A1 | 5/2008 | Dua et al. | |
| 2010/0154256 | A1 | 6/2010 | Dua | |
| 2011/0078921 | A1 | 4/2011 | Greene et al. | |
| 2012/0233884 | A1 | 9/2012 | Greene | |
| 2015/0059209 | A1 | 3/2015 | Dekovic et al. | |

FOREIGN PATENT DOCUMENTS

| | | | |
|---|---|---|---|
| CZ | 5497 | A3 | 7/1997 |
| DE | 196 00 720 | A1 | 8/1997 |
| ES | 2246716 | A1 | 2/2006 |
| JP | 2001336001 | A | 12/2001 |
| TW | 200530449 | A | 9/2005 |

OTHER PUBLICATIONS

Office Action, and English language translation thereof, in corresponding Taiwanese Application No. 105114216, dated Apr. 21, 2017, 11 pages.
Office Action and English Translation in corresponding Chinese Application No. 2018109324983, dated Jun. 30, 2020 (7 pages).
Non-Final Office Action received for U.S. Appl. No. 15/156,044, dated Jun. 13, 2018, 8 pages.
Notice of Allowance received for U.S. Appl. No. 15/156,044, dated Jan. 9, 2019, 5 pages.
Office Action received for European Patent Application No. 16726712.9, dated Jun. 21, 2021, 5 pages.

* cited by examiner

ARTICLE OF FOOTWEAR INCORPORATING A CURVED KNITTED LACING ELEMENT

CROSS-REFERENCE TO RELATED APPLICATIONS

This application is a continuation application of U.S. patent application Ser. No. 15/156,044, entitled "Article of Footwear Incorporating a Curved Knitted Lacing Element," filed May 16, 2016, which claims the benefit of priority of U.S. Provisional Application No. 62/162,305, entitled "Article of Footwear Incorporating a Curved Knitted Lacing Element," filed May 15, 2015. Each of the aforementioned applications is incorporated by reference herein in its entirety.

FIELD

The present disclosure generally relates to articles of footwear. More specific aspects of the present disclosure relate to articles of footwear incorporating an upper at least partially formed from knitted textile materials.

BACKGROUND

Conventional articles of footwear generally include two primary elements, an upper and a sole structure. The upper and the sole structure, at least in part, define a foot-receiving chamber that may be accessed by a user's foot through a foot-receiving opening.

SUMMARY

In one aspect, the disclosure provides a knitted lacing element. The knitted lacing element comprises a lace aperture, a boundary, and a plurality of knit courses. The plurality of knit courses comprise a first knit course and a second knit course extending from the boundary, wherein the lace aperture is disposed between the first knit course and the second knit course. The plurality of knit courses further comprise a contour section having at least one shortened knit course extending between the lace aperture and the boundary. Further, the first knit course and the second knit course are interlooped with the contour section in an area extending from the lace aperture toward the boundary, and the first knit course is interlooped with the second knit course in an area on an opposite side of the lace aperture.

In another aspect, the disclosure provides an article of footwear having an upper and a sole structure secured to the upper, wherein the upper incorporates a knitted component. The knitted component includes a first lacing element having a first inner boundary and a first lace aperture disposed proximate the first inner boundary. The first lacing element is formed by a first plurality of knit courses and comprises a first contour section comprising at least one shortened knit course extending between the first lace aperture and the first inner boundary. The first plurality of knit courses further comprises a first knit course and a second knit course extending from the first inner boundary, wherein the first lace aperture is disposed between the first knit course and the second knit course. Additionally, the first knit course and the second knit course are interlooped with the first contour section between the first inner boundary and the first lace aperture, and the first knit course is interlooped with the second knit course on an opposite side of the first lace aperture. Further, the knitted component and the first lacing element are formed of unitary knit construction.

In another aspect, the disclosure provides a method of making a knitted component for incorporating into an upper of an article of footwear. The method comprises knitting a first portion of the knitted component with at least one course, wherein the first portion extends from a first boundary toward a second boundary. The method then comprises knitting a second portion of the knitted component, wherein the second portion is formed of unitary knit construction with the first portion and comprises at least one course that extend from the first boundary toward a first aperture located between the first boundary and the second boundary. The method next comprises knitting a third portion of the knitted component, wherein the third portion is formed of unitary knit construction with the second portion and the first portion and comprises at least one course. The third portion further extends from the first boundary toward the second boundary and is interlooped with the second portion between the first boundary and the first aperture, and the third portion is interlooped with the first portion between the first aperture and the second boundary.

Other systems, methods, features and advantages of the aspects will be, or will become, apparent to one of ordinary skill in the art upon examination of the following figures and detailed description. It is intended that all such additional systems, methods, features and advantages be included within this description and this summary, be within the scope of the aspects, and be protected by the following claims.

BRIEF DESCRIPTION OF THE DRAWINGS

The aspects can be better understood with reference to the following drawings and description. The components in the figures are not necessarily to scale, emphasis instead being placed upon illustrating the principles of the aspects. Moreover, in the figures, like reference numerals designate corresponding parts throughout the different views.

DETAILED DESCRIPTION

The following discussion and accompanying figures disclose a variety of concepts relating to knitted components and the manufacture of knitted components. Although the knitted components may be utilized in a variety of products, the present disclosure sets forth an article of footwear that incorporates a knitted component forming a lacing element having a non-linear or curved edge. The curved edge may be described, in an exemplary aspect, as an undulate edge that has a smooth wave-like transition from convex to concave forms.

Figure 8:
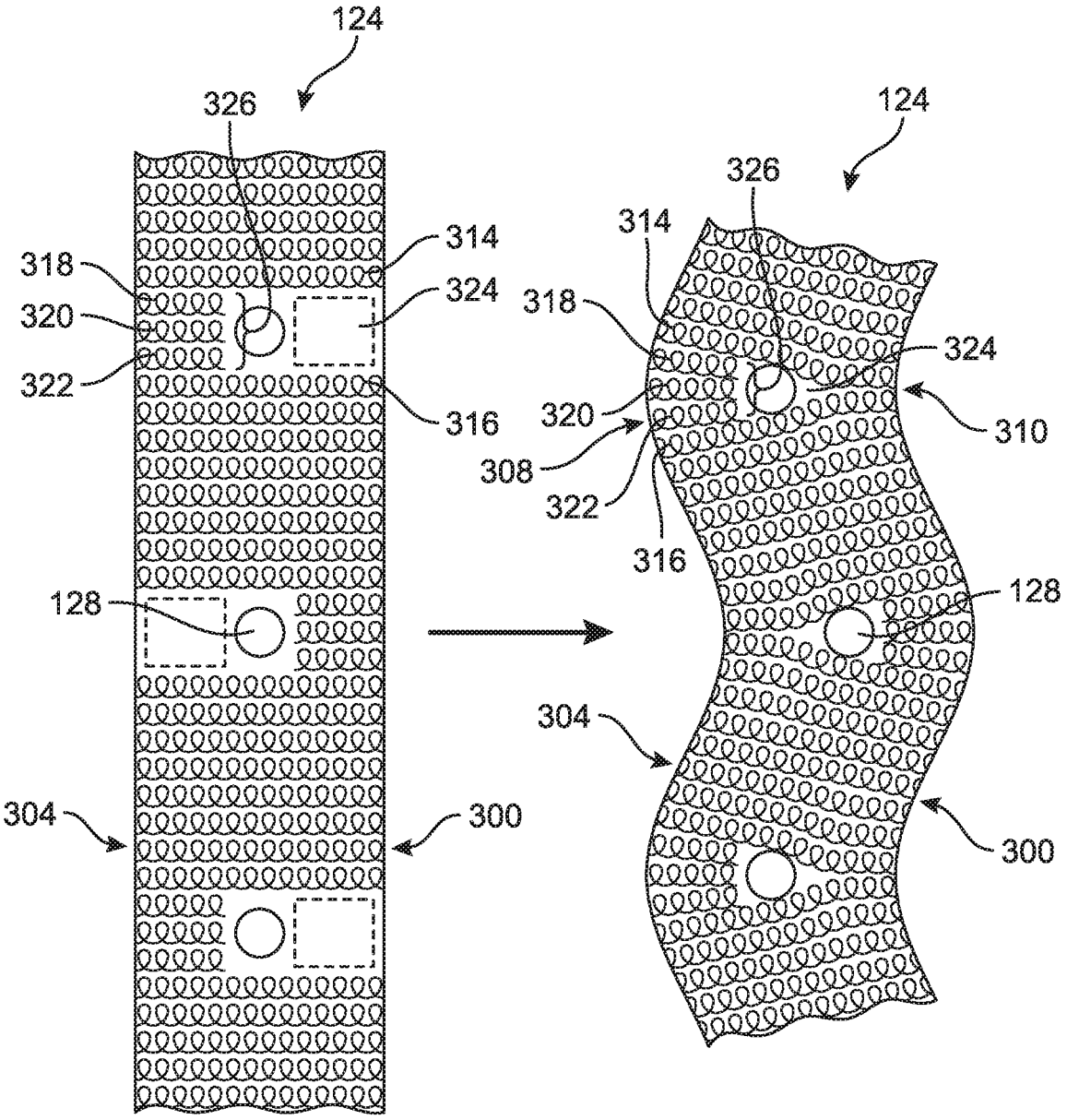
FIG. 8 is a representation of exemplary knit courses on a knitted component of an aspect as described herein.

The curved edge forming the undulating structure of the knitted component may be formed, in part, through providing a greater number of knit courses on a first side of an aperture than on an opposite side of the aperture, as is depicted in FIG. 8 discussed hereinafter. Specifically, it is contemplated that a knitted lacing element comprises a lace aperture, a boundary, and a plurality of knit courses. The plurality of knit courses comprise a first knit course and a second knit course extending from the boundary, wherein the lace aperture is disposed between the first knit course and the second knit course. The plurality of knit courses further comprise a contour section having at least one shortened knit course extending between the lace aperture and the boundary. Further, the first knit course and the second knit course are interlooped with the contour section in an area extending from the lace aperture toward the boundary, and the first knit course is interlooped with the second knit course in an area on an opposite side of the lace aperture.

Additionally and/or alternatively, the undulating structure of the knitted component may be formed, in part, through a varied course width and/or stitch tension on a first side of the aperture relative to the opposite side of the aperture. This varied course width and/or stitch tension may provide for a convex form on the first side of the aperture and a concave form on the opposite side of the aperture. As will be discussed herein, the manipulation of knitting techniques, such as the inclusion of a shortened knit course that does not extend the same length as an adjacent knit course, allows for the formation of curved edges with reduced strain on the knitted component when in forming a curved edge. The reduction in strain may reduce unintended deformations, such as puckering (e.g., a bulge). Therefore, the manipulation of knitting techniques may provide for a curved edge with greater aesthetic and functional utility, in exemplary aspects.

Further to knit construction techniques that may or may not be implemented on opposing sides of an aperture, it is contemplated that a post-knitting process may enhance and/or form the curved edge of the knitted component. For example, the knitted component, in an exemplary aspect, may be releasably secured with one or more elements, such as a lace aperture positioning element that is provided hereinafter with respect to FIG. 12, that assist in defining the curved edge. For example, one or more of the positioning elements may be fixedly secured to a plate such that when specified locations of the knitted component, such as apertures, are positioned about intended positioning elements, the relative location of the positioning elements to one another may guide and form the curved edge of the knitted component as the knitted component is mounted to the positioning elements.

Additionally, it is contemplated that an application of thermal energy, such as in the form of water-based steam, may be applied to the knitted component. As will be provided herein, the application of thermal energy may alter the characteristics of the knitted component, such as physical and/or chemical characteristics. Further to this example, the material of yarn, as will be discussed in greater detail herein after, may react to the thermal energy to lock, bind, integrate, and/or otherwise secure one or more loops/courses to another loop/course of the knitted component. This securing may be accomplished through physical changes to the material(s) and/or chemical changes to the material(s), in exemplary aspect. In a specific example, it is contemplated that the knitted component is formed, at least in part, with a thermally fuseable material, such as a fuseable yarn, that when exposed to sufficient thermal energy, the material bonds, either mechanically and/or chemically, with another element (e.g., loop and/or course) of the knitted component.

Additionally or alternatively, it is contemplated that a backing material may be secured with at least a portion of the knitted component to maintain and/or form the curved edge. For example, a thermoplastic polyurethane ("TPU") material may be affixed to at least a portion of a surface of the knitted component. The TPU, in this example, may be secured through adhesion, which may be achieved, in part, by an application of thermal energy to the TPU and knitted component. The TPU may coat and/or permeate the knitted component as the TPU is elevated to a softening and/or melting temperature. Upon a reduction in temperature from the softening and/or melting temperature, the TPU may secure, either fixedly or moveably, elements of the knitted component together in a defined configuration, such as a curved edge.

Therefore, it is contemplated that a knit configuration of the knitted component may be manipulated to form a curved edge, such as by including additional courses extending less than a full length (e.g., a shortened knit course) of a neighboring course. The additional shortened knit course(s) provides additional material effective to push apart adjacent courses that the shortened knit course is disposed between. The knit configuration manipulated may be further aided in forming a curved edge through a releasable securing of the knitted component to tooling (e.g., a positioning element) that forms, in part, a curved edge of the knitted component. Application of thermal energy to the knitted component may further form and/or secure the curved edge by physically and/or chemically altering the materials of the knitted component. For example, when the knitted component is formed, at least in part, with a thermally fuseable yarn, the thermal energy may cause the thermally fuseable yarn to secure one or more portions of the knitted component into a shape that is present during the application of the thermal energy. As such, it is contemplated that one or more techniques may be implemented individually or together to form a knitted component having a curved edge, such as an undulating edge in an exemplary aspect.

In particular, in some aspects, a lacing element for an article of footwear may be formed by providing at least one contour section containing at least one shortened knit course. The shortened knit course(s) may define a curved or non-linear boundary of the lacing element. For example, in some cases, the shortened knit course(s) may define a curved or non-linear edge of the lacing element, while in other cases the shortened knit courses may define an area where the appearance of the knitted component changes.

In some aspects, the lacing element can include a plurality of contour sections. The plurality of contour sections may each include shortened knit courses that are unitarily knit with each other and/or another knit course of the lacing element. In some aspects, the contour sections may comprise several rows of additional shortened knitted courses that are unitarily knit on alternating sides of a plurality of lace apertures, causing the lace apertures to be offset from each other. By incorporating contour sections into the knitted component, the lace apertures may be offset from each other creating a curved edge shape, and providing distribution of tension applied by a lace along the footwear upper. As such, the configuration of the lacing element may impart both aesthetic and functional qualities to the article of footwear. FIGS. 1-4 depict several views of an aspect of an article of footwear 100 incorporating both a knitted lateral lacing element 124 and a knitted medial lacing element 125.

The following Detailed Description is organized with a variety of discussion focus segments hereinafter that are generally provided as:

1) Exemplary Footwear Configuration,

2) Exemplary Knitted Component,

3) Exemplary Knitted Component Lacing Element Configuration,

4) Additional Exemplary Aspects,

5) Method of Forming Exemplary Knitted Components, and

6) Knitting Machine Configuration

The various focus segments listed above and provided below are not intended to be limiting to the present disclosure, but instead they are provided to ease comprehension of the aspects provided herein.

Exemplary Footwear Configuration

Turning to FIGS. 1-4, an article of footwear 100 is depicted as including a sole structure 102 and an upper 104. Although article of footwear 100, which is also referred to hereafter as simply "article," is illustrated as having a general configuration suitable for running, concepts associated with footwear may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear apply to a wide variety of footwear types.

The upper 104 is secured to the sole structure 102 and forms a void on the interior of the footwear for receiving a foot in a comfortable and secure manner. The upper 104 may secure the foot with respect to the sole structure 102. The upper 104 may extend around the ankle, over the throat, and across the toe areas of the foot. The upper 104 may also extend along the medial and lateral sides of the foot as well as the heel of the foot. The upper 104 may also incorporate a fastening system that permits the wearer to adjust the dimensions of the upper to tighten and secure the upper around the foot. In addition, the upper 104 may be configured to protect the foot and provide ventilation, thereby cooling the foot. Further, the upper 104 may include additional material to provide extra support in certain areas.

The sole structure 102, in an exemplary aspect, is secured to a lower area of the upper 104, such as proximate an outer perimeter boundary of the upper, as discussed herein, thereby positioned between the upper 104 and the ground. The sole structure 102 may include a midsole and an outsole. The midsole often includes a polymer foam material that attenuates ground reaction forces to lessen stresses upon the foot and leg during walking, running, and other ambulatory activities. Additionally, the midsole may include fluid-filled chamber, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

Figure 2:
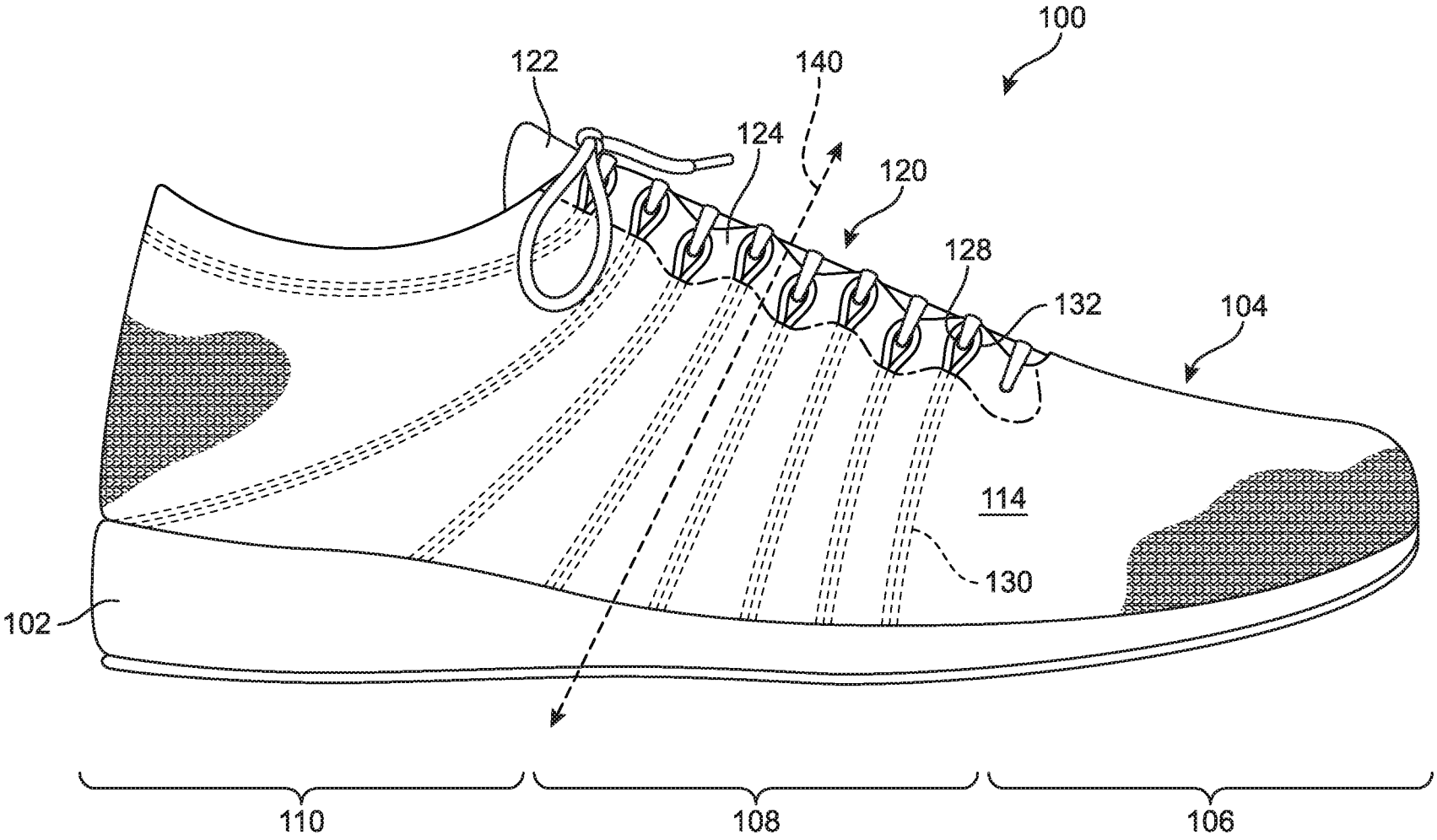
FIG. 2 is a lateral side elevation view of the aspect of FIG. 1.
Figure 3:
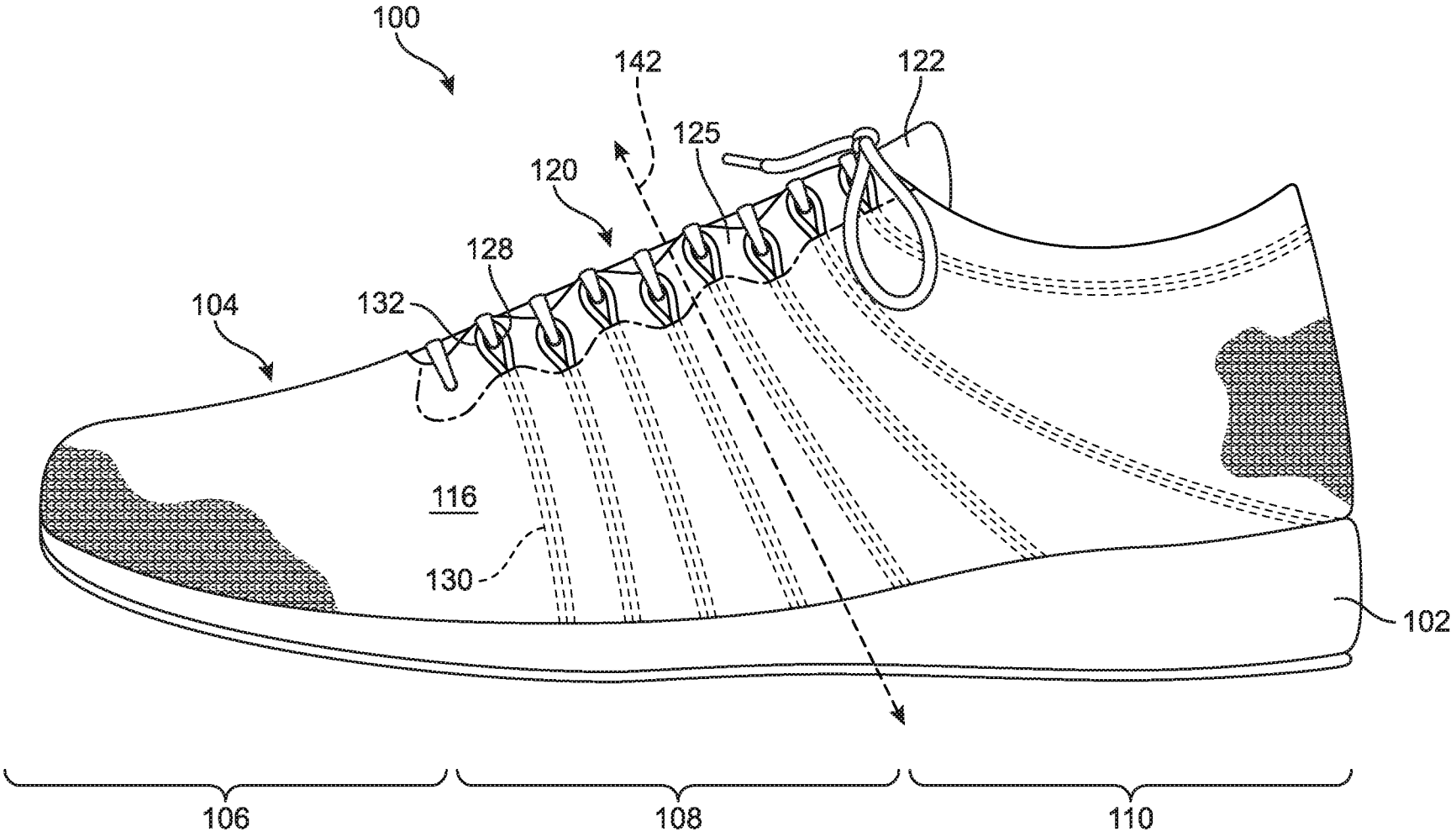
FIG. 3 is a medial side elevation view of the aspect of FIG. 1.
Figure 4:
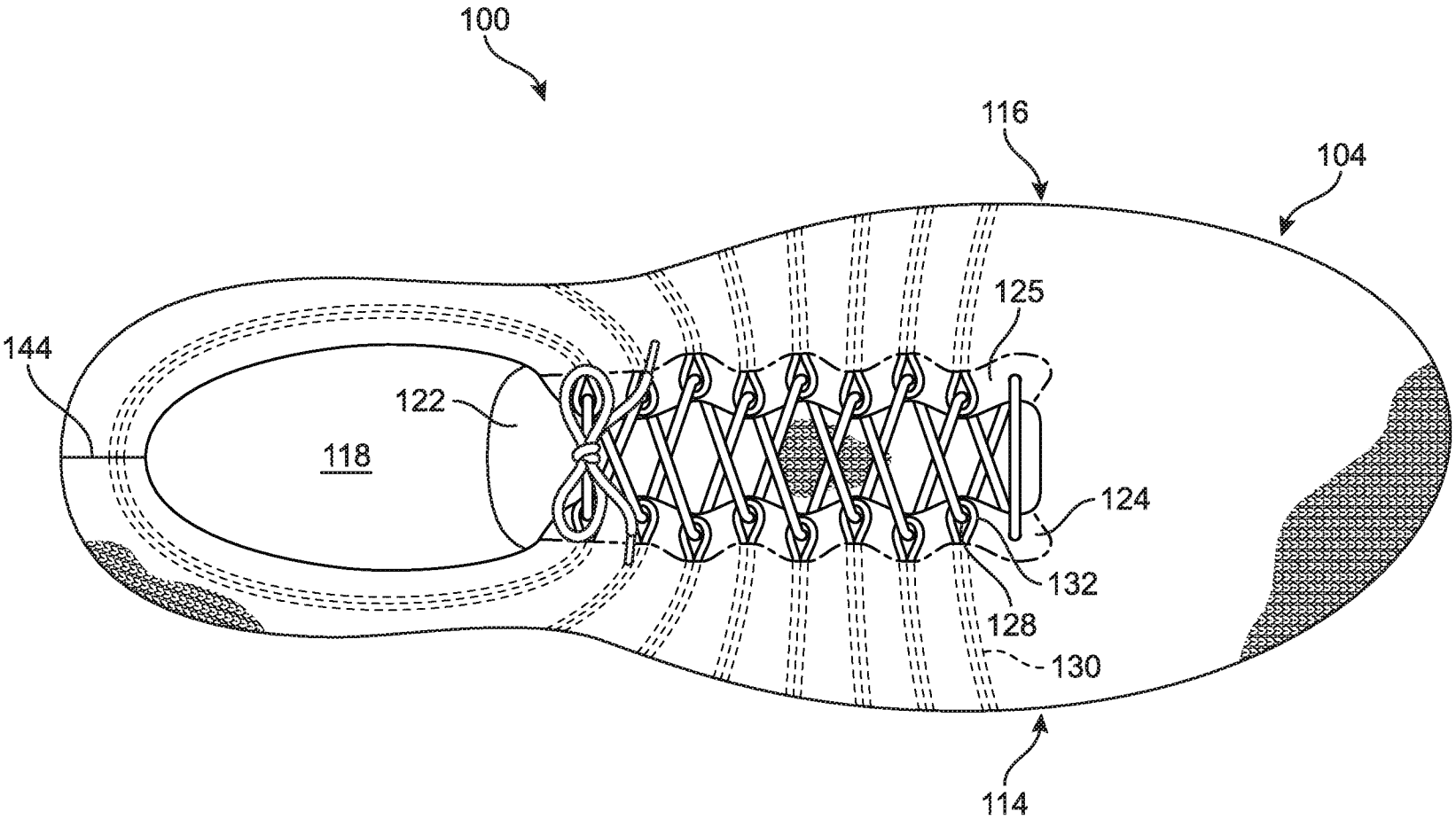
FIG. 4 is a top view of the aspect of FIG. 1.

As shown in FIGS. 2-3, article 100 may be divided into three general regions: a forefoot region 106, a midfoot region 108, and a heel region 110. Forefoot region 106 generally includes portions of article 100 corresponding with the toes and the joints connecting the metatarsals with the phalanges. Midfoot region 108 generally includes portions of article 100 corresponding with an arch area of the foot. Heel region 110 generally corresponds with rear portions of the foot, including the calcaneus bone. Article 100 also includes a lateral side 114 and a medial side 116, which extend through forefoot region 106, midfoot region 108, and heel region 110, and correspond with opposite sides of footwear. More particularly, lateral side 114 corresponds with an outside area of the foot, and medial side 116 corresponds with an inside area of the foot (i.e., the surface that faces toward the other foot). Forefoot region 106, midfoot region 108, heel region 110, lateral side 114, and medial side 116 are not intended to demarcate precise areas of footwear. Rather, forefoot region 106, midfoot region 108, heel region 110, lateral side 114, and medial side 116 are intended to represent general areas of article 100 to aid in the following discussion. In addition to article 100, forefoot region 106, midfoot region 108, heel region 110, lateral side 114, and medial side 116 may also be applied to sole structure 102, upper 104, and individual elements thereof, in the following discussion.

Further, reference may be made to directional descriptions. "Longitudinal direction" as used throughout this detailed description and in the claims refers to a direction extending the length of an article or component or portions thereof. In some cases, the longitudinal direction may extend from forefoot region 106 to heel region 110 or portions. The term "lateral direction" as used throughout this detailed description and in the claims refers to a direction extending a width of an article or portions thereof. In other words, the lateral direction may extend between lateral side 114 and medial side 116 of an article. Furthermore, the term "vertical direction" as used throughout this detailed description and in the claims refers to a direction extending from the sole structure 102 to a throat area 120 of article 100. For example, a vertical direction 140 on a lateral side of the article is indicated by a dashed line in FIG. 2 and a vertical direction 142 on a medial side of the article is indicated by a dashed line in FIG. 3 for illustrative purposes.

In an aspect, sole structure 102 is secured to upper 104 and extends between the foot and the ground when article 100 is worn. In some aspects, the primary elements of sole structure 102 may include a midsole, an outsole, and a sockliner. In an exemplary aspect, sole structure 102 may include an outsole. In an aspect, the outsole may be secured to a lower surface of upper 104. The outsole may also be secured to a base portion configured for securing sole structure 102 to upper 104. Although the configuration for sole structure 102 provides an example of a sole structure that may be used in connection with upper 104, many other conventional or nonconventional configurations for sole structure 102 may be utilized. Accordingly, the features of sole structure 102, or any sole structure used with upper 104, may vary in other aspects.

For example, in other aspects, sole structure 102 may include a midsole and/or a sockliner. The midsole may be secured to a lower surface of an upper and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other configurations, midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of article of footwear 100.

In some aspects, upper 104 defines a void within article 100 for receiving and securing a foot relative to sole structure 102. The void is shaped to accommodate a foot and extends along the lateral side of the foot, along a medial side of the foot, over the foot, around the heel, and under the foot. Access to the void is provided by an ankle opening 118 located in at least the heel region 110. The foot may be inserted into upper 104 through ankle opening 118. The foot may be withdrawn from upper 104 through ankle opening 118. In some aspects, a throat area 120 may extend forward from ankle opening 118 over an area corresponding approximately to an instep of the foot in midfoot region 108 to the forefoot region 106.

In some aspects, upper 104 may include a tongue portion 122. Tongue portion 122 may be disposed between lateral side 114 and medial side 116 of upper 104 in the throat area 120. Tongue portion 122 may be integrally attached to upper 104. In some aspects, tongue portion 122 may be formed of unitary knit construction, which is defined in further detail below, with portions of upper 104. Accordingly, upper 104 may extend substantially continuously across throat area 120 between lateral side 114 and medial side 116. In some aspects, tongue portion 122 may be attached along lateral side 114 and medial side 116 of throat area 120. In other aspects, tongue portion 122 may be disconnected along the sides of throat area 120 allowing for tongue portion 122 to be moveable between the sides of throat area 120.

A lace 126 or other fastening system may extend through various lace apertures 128 to secure article 100 to the wearer's foot and to further enhance the comfort of article 100. Lace 126 may allow for the wearer to modify the dimensions of upper 104 to accommodate proportions of the foot. In some aspects, lace 126 may extend through lace apertures 128 that are disposed along either side of throat area 120. In some aspects, lace apertures 128 are integrally formed in a lacing element 124 of upper 104. In some aspects, an inlaid strand or tensile element 130 may also be integrally formed with upper 104 and form a loop 132 for receiving lace 126, providing additional structure to upper 104. Lace 126 may permit the wearer to tighten upper 104 around the foot. Lace 126 may also permit the wearer to loosen upper 104 to facilitate entry and removal of the foot from the void. In addition, tongue portion 122 of upper 104 in throat area 120 extends under lace 126 to enhance the comfort of article 100. In some aspects, lace apertures 128 may include another material, for example, a reinforcing material. In still other aspects, the fastening system may incorporate other structures, such as hook-and-loop fasteners, zippers or other fastening techniques contemplated by a skilled artisan. In further configurations, upper 104 may include additional elements, such as (a) a heel counter in heel region 110 that enhances stability, (b) a toe guard in forefoot region 106 that is formed of wear-resistant material, and (c) logos, trademarks, and placards with care instructions and material information.

Exemplary Knitted Component

Many conventional footwear uppers are formed from multiple material elements (e.g., textiles, polymer foam, polymer sheets, leather, synthetic leather) that are joined through stitching or bonding, for example. In contrast, in some aspects, a majority of upper 104 is formed from a knitted component 134, which will be discussed in more detail below. Knitted component 134 may, for example, be manufactured through a flat knitting process and extend through one of more of forefoot region 106, midfoot region 108, and heel region 110 along both lateral side 114 and medial side 116.

In an exemplary aspect, knitted component 134 forms most or substantially all of upper 104 including exterior surface 136, and a majority or a relatively large portion of interior surface 138 (see FIG. 1) thereby defining a portion of the void within upper 104. In some aspects, knitted component 134 may also extend under the foot. In other aspects, however, a strobel sock or thin sole-shaped piece of material is secured to knitted component 134 to form a base portion of upper 104 that extends under the foot for attachment with sole structure 102. In addition, a seam 144 may extend through the heel region 110, to join edge 208 and edge 210 (referenced in FIGS. 4 and 5) of knitted component 134.

Although seams may be present in knitted component 134, a majority of knitted component 134 may have a substantially seamless configuration. Moreover, knitted component 134 may be formed of unitary knit construction. As utilized herein, a knitted component (e.g., knitted component 134) is defined as being formed of "unitary knit construction" when formed as a one-piece element through a knitting process. That is, the knitting process substantially forms the various features and structures of knitted component 134 without the need for significant additional manufacturing steps or processes. A unitary knit construction may be used to form a knitted component having structures or elements that include one or more courses of yarn, strands, or other knit material that are joined such that the structures or elements include at least one course in common (i.e., sharing a common yarn), include courses that are interlooped with each other, and/or include courses that are substantially continuous between each of the structures or elements. The structures or elements formed of unitary knit construction may also be referred to as being "unitarily knit." With this arrangement, a one-piece element of unitary knit construction is provided.

Although portions of knitted component 134 may be joined to each other (e.g., as heel edges 208 and 210 may be joined to form seam 144) following the knitting process, knitted component 134 remains formed of unitary knit construction because it is formed as a one-piece knit element. Moreover, knitted component 134 remains formed of unitary knit construction when other elements (e.g., a lace, logos, trademarks, placards with care instructions and material information, structural elements) are added following the knitting process.

Knitted component 134 may incorporate various types of yarn that impart different properties to separate areas of upper 104. That is, one area of knitted component 134 may be formed from a first type of yarn that imparts a first set of properties, and another area of knitted component 134 may be formed from a second type of yarn that imparts a second set of properties. In this configuration, properties may vary throughout upper 104 by selecting specific yarns for different areas of knitted component 134. The properties that a particular type of yarn will impart to an area of knitted component 134 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability.

In addition to materials, other aspects of the yarns selected for knitted component 134 may affect the properties of upper 104. For example, a yarn forming knitted component 134 may be a monofilament yarn or a multifilament yarn. The yarn may also include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of upper 104. Further still, a yarn having heat fusible properties may be selected. Such a heat fusible yarn would allow the structure and integrity to be altered where heat is applied to the knitted component. Accordingly, both the materials forming the yarn and other aspects of the yarn may be selected to impart a variety of properties to separate areas of upper 104.

Figure 5:
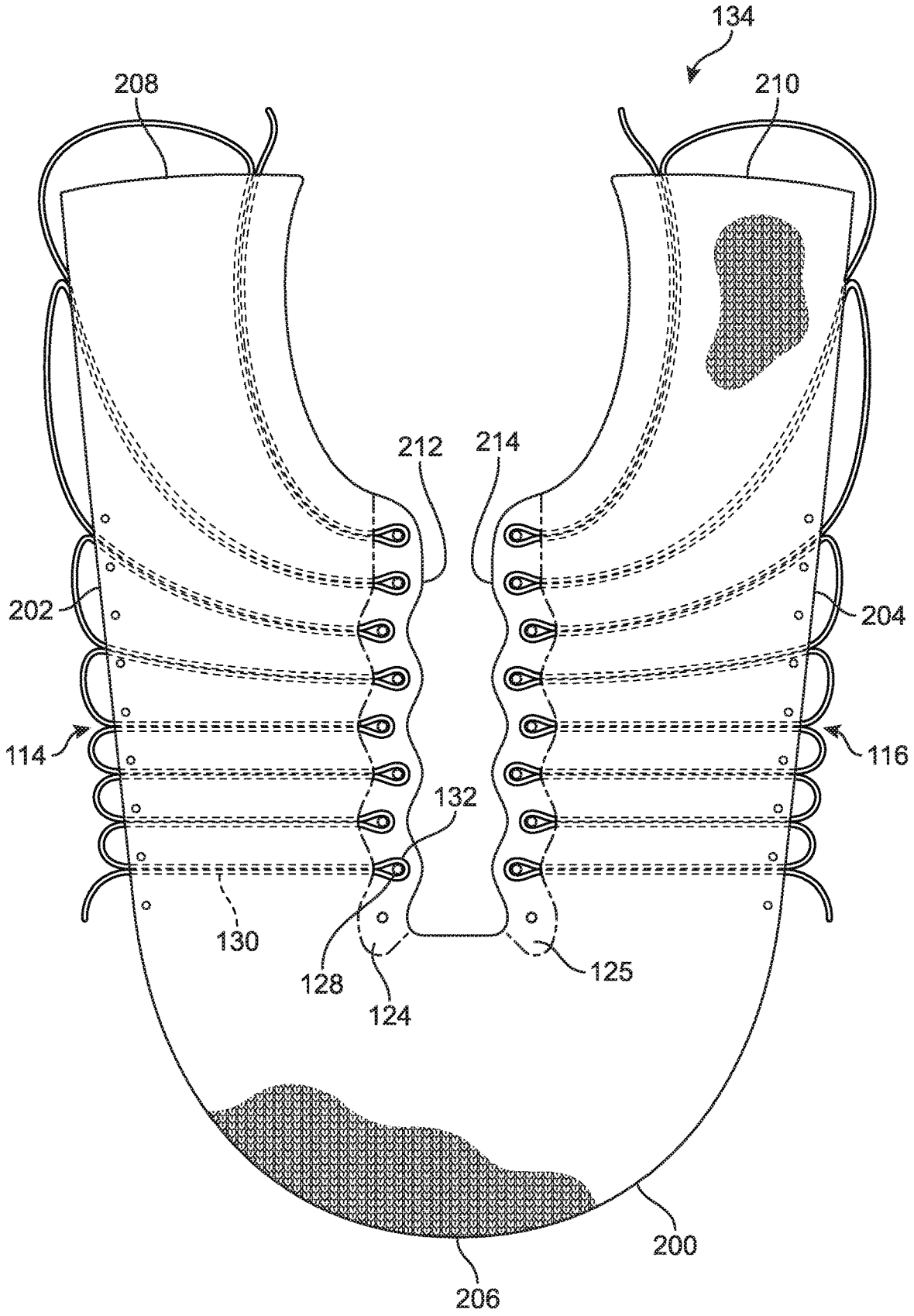
FIG. 5 is an aspect of a knitted component formed according to techniques described herein.

Referring to FIG. 5, an exemplary aspect of knitted component 134 is shown in a planar or flat configuration. Knitted component 134 is generally produced and configured in an augmented U-shape, before being incorporated into upper 104. Knitted component 134 is outlined by an outer perimeter edge 200. Outer perimeter edge 200 includes lateral edge 202, medial edge 204, forefoot edge 206, heel edge 208 and heel edge 210. Knitted component 134 may also include a lateral inner edge 212 and a medial inner edge 214. In knitted component 134, lateral inner edge 212 and medial inner edge 214 may also correspond with a lateral inner boundary and medial inner boundary of curved lacing element 124, discussed in further detail below. When incorporated into an article of footwear, outer perimeter edge 200 may lay against an upper surface of sole structure 102. In addition, heel edge 208 and heel edge 210 may be joined to each other and extend generally perpendicular to sole structure 102 in heel region 110. In other aspects, knitted component 134 may be joined to a strobel sock or sockliner for attachment to sole structure 102.

Knitted component 134 may be formed from at least one yarn that is manipulated (e.g., with a knitting machine) to form a plurality of intermeshed loops that define a variety of courses and wales. That is, knitted component 134 has the structure of a knit textile. It will be further understood that a variety of types of knit structures may be used to create knitted component 134. In some cases, weft knitting techniques may be used to create knitted component 134. For example, flat knitting techniques may be used, including for example, flat knitting techniques incorporating various stitch structures such as single jersery knit, double jersey knit, and links-links. In other cases, various warp knitting techniques may be used. In an exemplary aspect, knitted component 134 may be formed using weft knitting techniques on a flat knitting machine, described in more detail below.

A knit course, as discussed throughout the description and claims, refers to interlooped yarns or strands forming a row of loops that are being joined to successive courses through a knitting process. The knitting direction may be generally defined relative to the direction of the knit material being formed during the knitting process. For example, during a flat knitting process, successive courses of interlooped yarns are joined together to form a knit element by manipulating a yarn through knitting a course or row along a first direction to increase the size of the knitted component along a second direction, the second direction being generally perpendicular to the first direction. In addition, courses or portions of courses may be skipped or altered to alter the look and orientation of a final knitted product. As discussed in further detail below, altered knit courses along a lacing structure area of a knitted component may result in desirable characteristics in lacing tension.

In some cases, extra elements may be incorporated into and/or with knitted component 134 to provide support, stretchability, or other desirable qualities to article 100. In one aspect, a tensile element 130 may be utilized to provide additional support and to prevent excessive stretch of the knit yarns around a wearer's foot. The tensile element 130 may be inlaid, tunneled, or otherwise moveably or immovably secured with the knitted component 134. For example, tensile element 130 may extend through knitted component 134 and pass through various loops within knitted component 134 as an inlaid tensile element. When inlaid, tensile element 130 may generally extend along the courses within knitted component 134; however, in some aspects, a tensile element 130 may extend along the wales within knitted component 134. When knitted component 134 is incorporated into article 100, tensile element 130 may impart stretch resistance in certain areas within article 100. With respect to the methods and systems for incorporating a tensile element 130 into knitted component 134, reference is made to U.S. Pat. No. 8,839,532, filed on Mar. 15, 2011, which is incorporated herein by reference, in its entirety. It will also be understood, however, that in some aspects knitted component 134 and article 100 may also be configured without tensile element 130 and still fall within the spirit and scope of the present disclosure.

In some aspects, tensile element 130 may be incorporated such that tensile element 130 interacts with lace 126. More particularly, tensile element 130 may extend along knit courses running in a generally vertical direction, from sole structure 102 to throat area 120. In some aspects, tensile element 130 may be used to form loop 132. Accordingly, in some aspects, the portion of tensile element 130 forming loop 132 may augment lace aperture 128. In some cases, tensile element 130 may exit knitted component 134, such as an outer perimeter of the upper and/or the throat area 120. Thus, the exposed portions of tensile element 130 may interact with sole structure 102 and lace 126. The interaction with lace 126 and/or sole structure 102 may assist with securing upper 104 around the foot.

Figure 1:
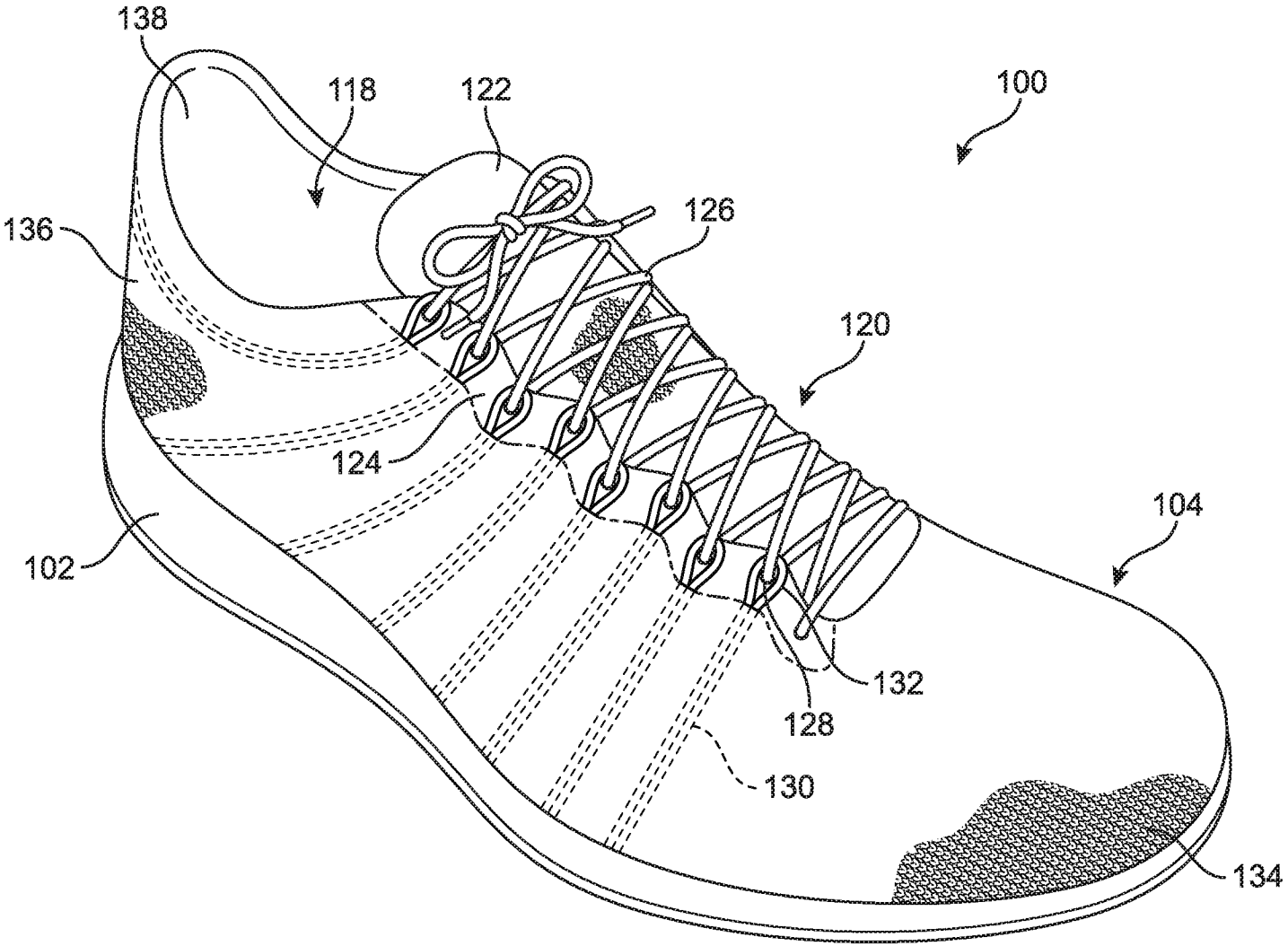
FIG. 1 is a perspective view of an aspect of an article of footwear formed according to aspects described herein.

Lace apertures 128 may extend through knitted component 134 from exterior surface 136 to interior surface 138 (as shown in FIG. 1). Lace apertures 128 may be formed directly into the knitted component 134 by knitting, as would be understood by a skilled artisan. In other aspects, lace apertures 128 may be created by a separate yarn or inlaid strand. Lace apertures 128 may be configured to accept lace 126.

Exemplary Knitted Component Lacing Element Configuration

Some aspects may include provisions to distribute the tension applied by a fastening system, e.g. lace 126, that may ultimately act upon a knitted component, and an upper. In some aspects, tension distribution may be achieved by providing a lacing element with at least one contour section containing at least one shortened knit course. The shortened knit course(s) may define a curved or non-linear boundary, such as a terminal edge, of the lacing element, as can be seen in FIG. 8 and discussed hereafter. In some aspects, the lacing element can include a plurality of contour sections. The plurality of contour sections may each include shortened knit courses that are unitarily knit on alternating sides of the lace apertures of a knitted component, causing the lace apertures to be positioned at varying vertical positions on the knitted component, and ultimately at varying vertical positions on the lateral side 114 and medial side 116 of the footwear upper. By varying the position of the lace apertures, the tension provided by the lace may be distributed more effectively along the footwear upper. In some aspects, a knitted component may be configured to better distribute the tension applied by a lace across the footwear upper.

In an exemplary aspect, a knitted component may be provided with a curved lacing structure disposed in throat area 120. In one aspect, the curved lacing structure can include lace apertures that are shifted to alternating vertical positions. By inserting additional, shortened, knitted courses on alternating sides of a lace aperture, a curved lacing structure may be achieved, allowing for alternating vertical distribution of the lace apertures, and thus, the vertical distribution of tension through throat area 120. In at least one aspect, the curved lacing structure can include one or more curved lacing elements on either side of throat area 120. Each curved lacing element may include a plurality of lace apertures that are shifted to alternating vertical positions to form the curved lacing structure.

As depicted FIGS. 1-5, knitted component 134 may incorporate provisions that augment both the aesthetic and the functional aspects of upper 104. For example, in some cases, portions of knitted component 134 may serve to disperse tension applied by lace 126 more evenly across a wearer's foot. In particular, in some aspects knitted component 134 may incorporate a curved lacing structure formed by a lateral lacing element 124 and a medial lacing element 125 in throat area 120. In one aspect, lateral lacing element 124 and medial lacing element 125 may be formed of unitary knit construction with the remaining portion of upper 104, as described above. Further, lateral lacing element 124 and medial lacing element 125 may each include a plurality of lace apertures 128 disposed in knitted component 134. In at least one aspect, both lateral lacing element 124 and medial lacing element 125 form curved inner and outer boundaries, and lace apertures 128 may be offset from each other in the vertical direction with respect to the formed upper 104 of article 100.

Figure 6:
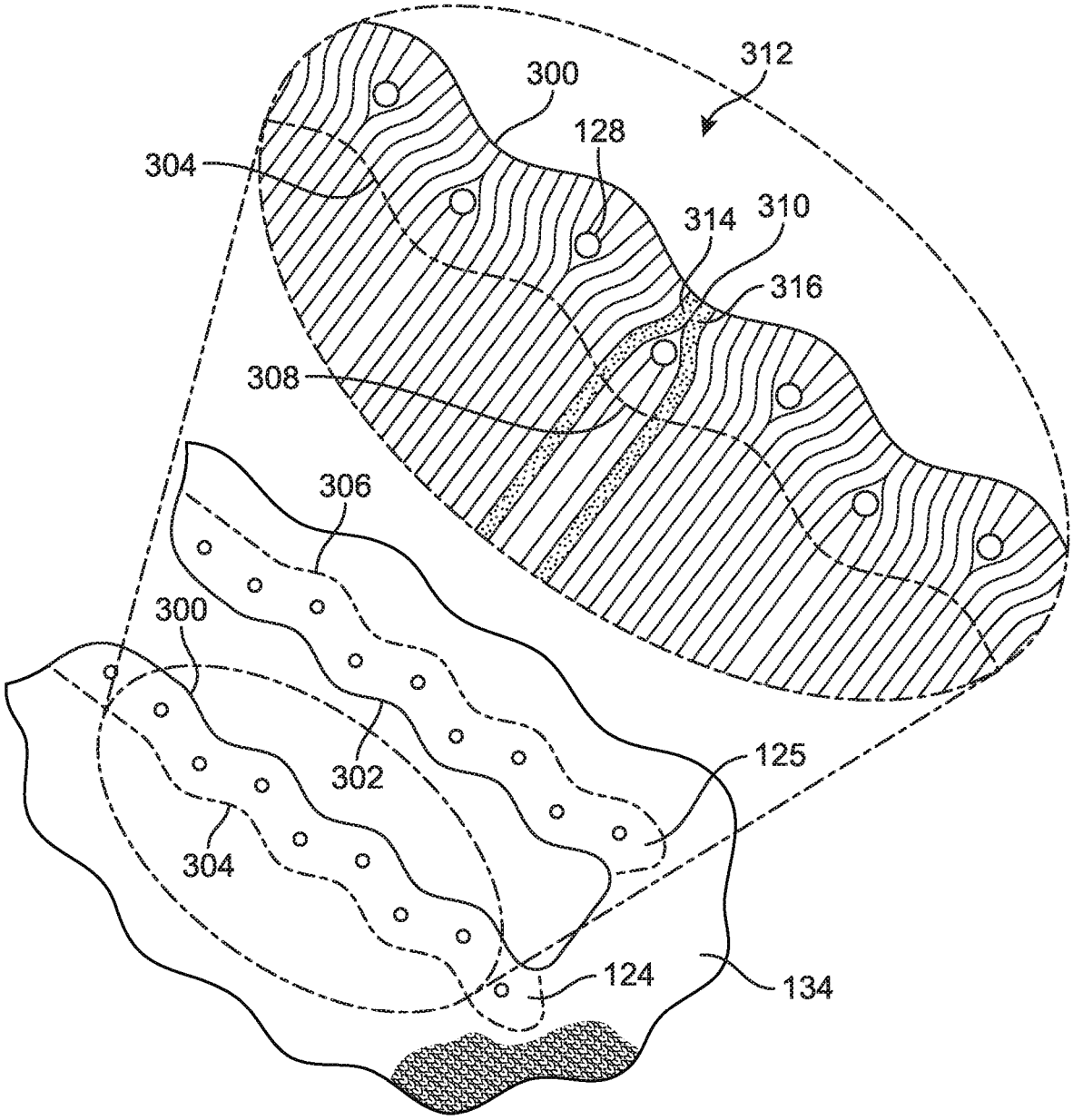
FIG. 6 is a close-up view of an aspect of a knitted component formed according to aspects described herein.
Figure 7:
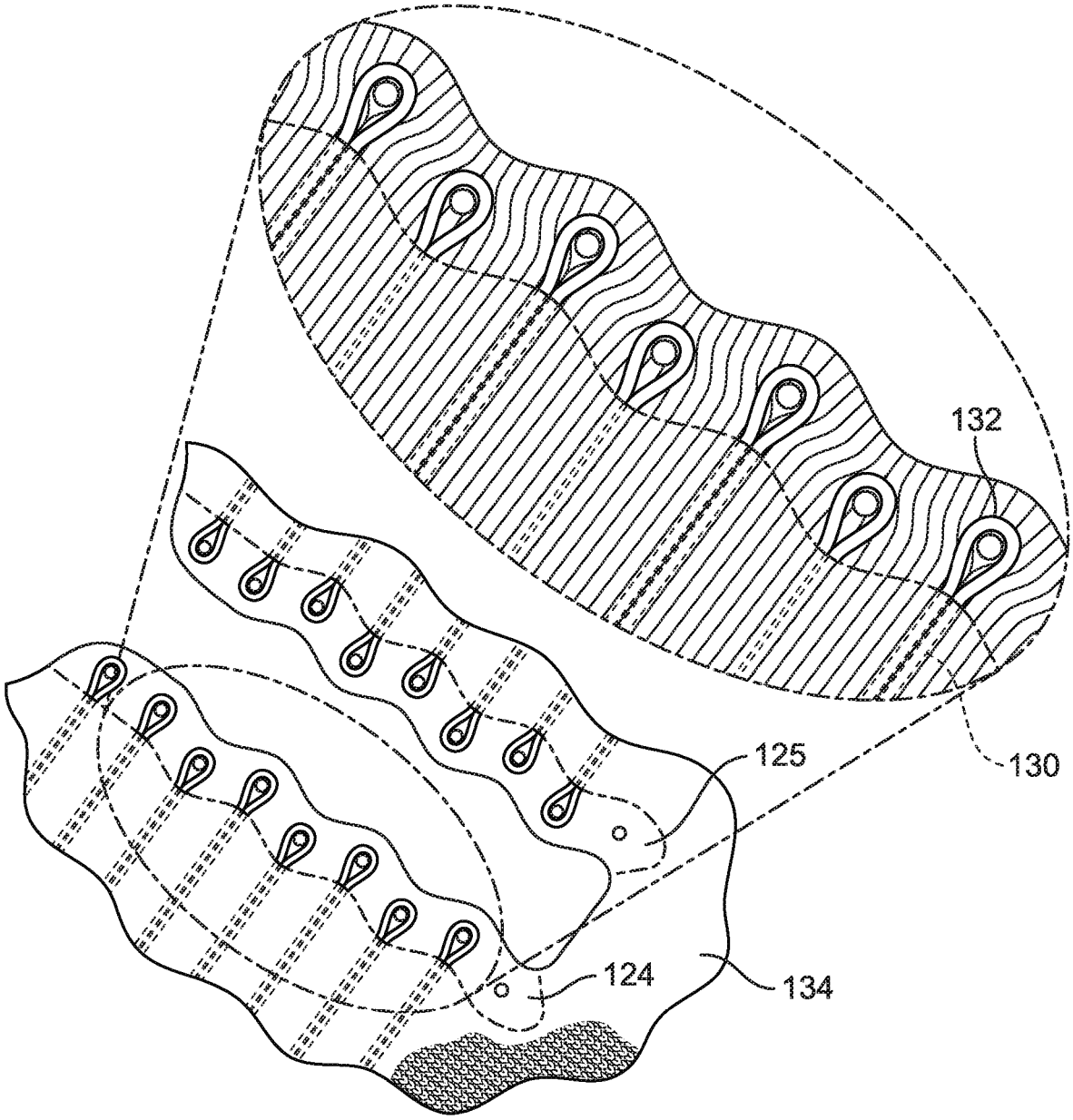
FIG. 7 is a close-up view of another aspect of a knitted component formed according to aspects described herein.

FIGS. 6-8 depict close-up views of lateral lacing element 124 formed according to at least one aspect described herein. Medial lacing element 125, while not shown in detail in FIGS. 6-8, may have the same general configuration and properties as lateral lacing element 124. In some cases, medial lacing element 125 and lateral lacing element 124 may be substantially identical. In other cases, medial lacing element 125 and lateral lacing element 124 may be substantially similar mirror images of each other. In still other cases, medial lacing element 125 and lateral lacing element 124 may have substantially different configurations. In addition, for clarity of figure and discussion purposes, FIG. 6 depicts an aspect without tensile element 130 while FIG. 7 incorporates tensile element 130. It should be readily understood that articles embodying aspects described herein may or may not incorporate tensile element 130 and still fall within the spirit and scope of the present disclosure.

As seen in FIG. 6, both lateral lacing element 124 and medial lacing element 125 may include curved interior and exterior boundaries. Specifically, lateral lacing element 124 may include curved inner lateral boundary 300 and curved outer lateral boundary 304, and medial lacing element 125 may include curved inner medial boundary 302 and curved outer medial boundary 306. Curved outer lateral boundary 304 and curved outer medial boundary 306 are depicted with dashed lines in the figures to denote that lateral lacing element 124 and medial lacing element 125 may be formed of unitary knit construction with adjacent areas of knitted component 134. For example, in some aspects, lateral lacing element 124 can be formed of unitary knit construction with a lateral side 114 of knitted component 134. Likewise, in some aspects, medial lacing element 125 can be formed of unitary knit construction with a medial side 116 of knitted component 134. Thus, while there may be a discernable change in the appearance of the knit structure in lateral lacing element 124 and medial lacing element 125, in at least one aspect, both lateral lacing element 124 and medial lacing element 125 are formed of unitary knit construction with adjacent areas of knitted component 134 so that knitted component 134 is a one-piece element. In such aspects, curved inner lateral boundary 300, curved outer lateral boundary 304, curved inner medial boundary 302, and/or curved outer medial boundary 306 may simply denote a change in the appearance of the knit, and they do not signify where the lacing element terminates. For example, it is contemplated that a knitting technique may transition from a first knitting technique (e.g., stitch type) to a second knitting technique at one or more of the curved inner lateral boundary 300, curved outer lateral boundary 304, curved inner medial boundary 302, and/or curved outer medial boundary 306. Therefore, a boundary may not be an edge, but instead a transitional area between one characteristic (e.g., aesthetic and/or functional) and another characteristic.

Figure 15:
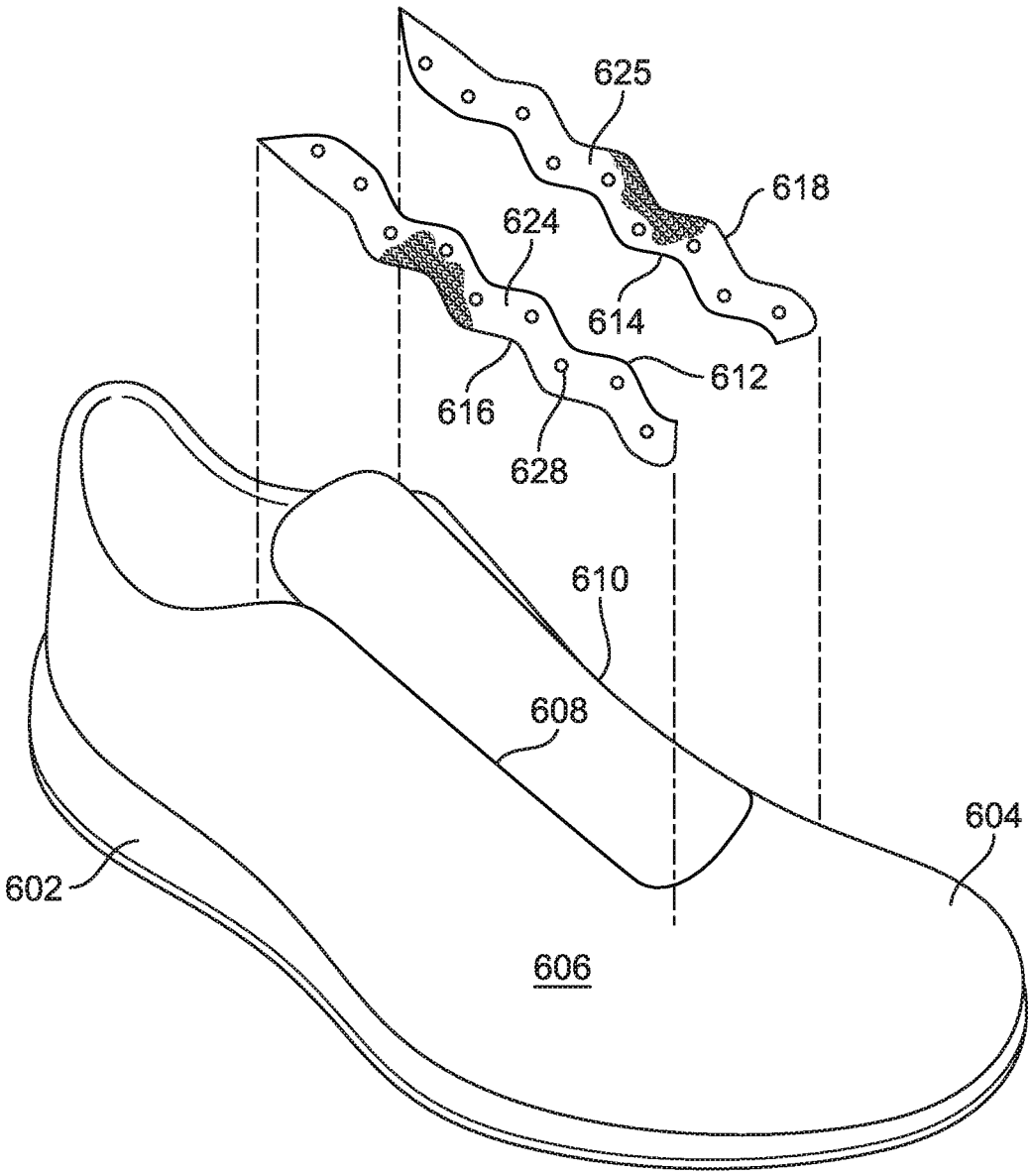
FIG. 15 is an exploded view of another aspect of an article of footwear according to aspects described herein.
Figure 16:
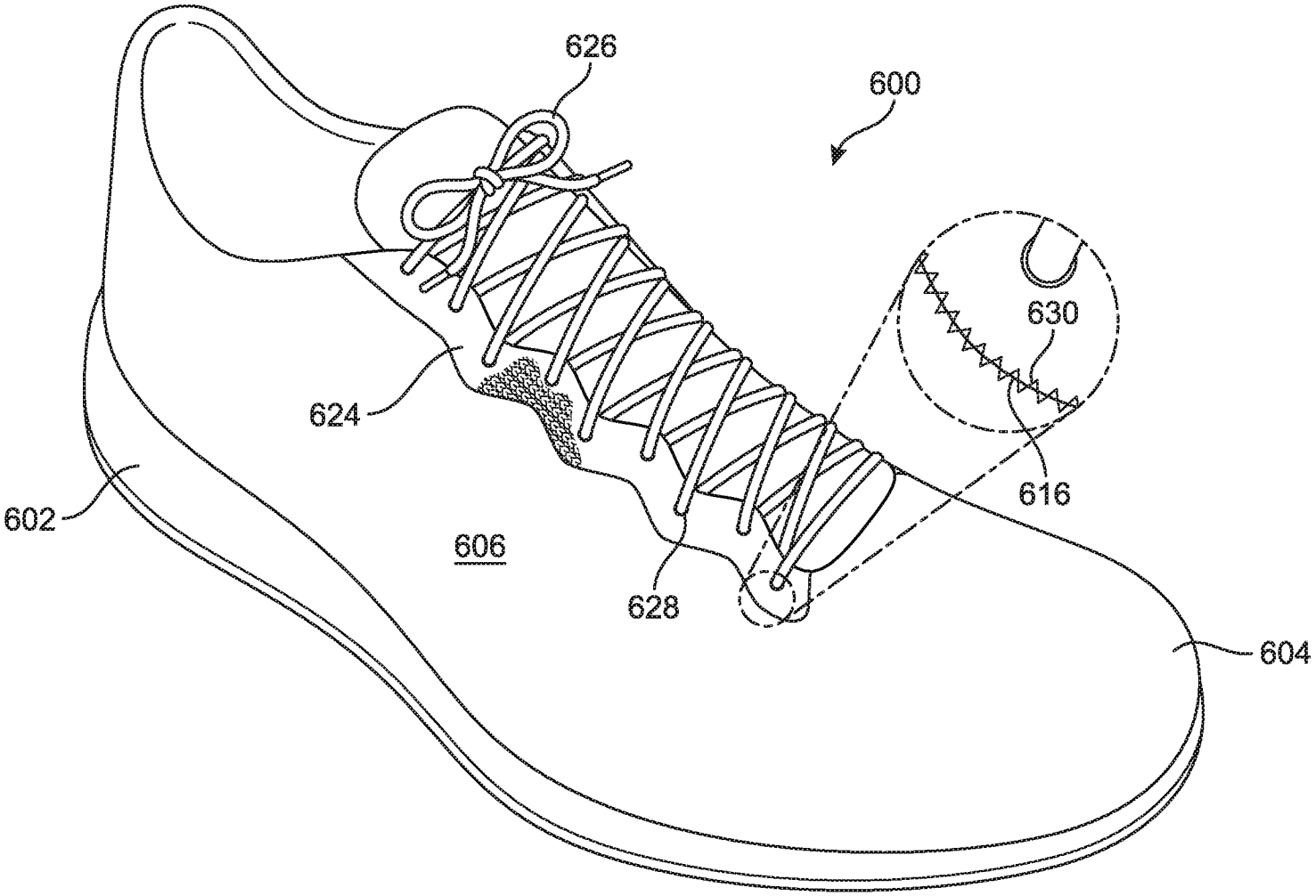
FIG. 16 is a perspective view of another aspect of an article of footwear according to aspects described herein.

However, in other aspects, including in one aspect discussed below in relation to FIGS. 15-17, lacing elements may be independently knitted and subsequently attached to the remainder of the footwear upper. Thus, in some aspects, curved inner lateral boundary 300, curved outer lateral boundary 304, curved inner medial boundary 302 and curved outer medial boundary 306 may denote where the lacing element terminates.

In at least one aspect, each curved boundary of lateral lacing element 124 and medial lacing element 125 may alternate between a convex and concave orientation to impart a "wavy" or undulating appearance. Referring to the close up representation of lateral lacing element 124 in FIG. 6, for example, as curved outer lateral boundary 304 forms a convex surface 308 (i.e., convex toward lateral edge 202 of knitted component 134), curved inner lateral boundary 300 forms a concave surface 310 (i.e., concave toward lateral edge 202 of knitted component 134). This alternating convex-to-concave orientation may continue along substantially the entire length of both curved outer lateral boundary 304 and curved inner lateral boundary 300. Likewise, medial lacing element 125 may include the same alternating convex-to-concave orientation along curved outer medial boundary 306 and curved inner medial boundary 302.

Lateral lacing element 124 and medial lacing element 125 may be formed and incorporated into upper 104 in a variety of ways. In some aspects, curved lateral lacing element 124 and medial lacing element 125 may be integrally knit and formed of unitary knit construction with adjacent rows of knitted component 134. However, in other aspects, lacing elements may be formed as independent knitted elements (discussed in further detail below). In at least one aspect, referring to FIG. 6, a plurality of knit courses 312 may be combined to form knitted component 134. Knit course 314 and knit course 316 are shaded as each being representative of a single knit course in knitted component 134.

According to at least one aspect, lateral lacing element 124 and medial lacing element 125 may be formed on a standard flat knitting machine as integral and unitary portions of knitted component 134. In FIGS. 6 and 7, exemplary individual knit courses are depicted to represent standard knit courses that may be produced by a knitting machine, such as knitting machine 400, depicted in FIG. 9 and discussed in more detail below. For example, knit course 314 and knit course 316 are examples of knit courses that may run from lateral edge 202 to lateral inner edge 212 of knitted component 134.

To form curved lateral lacing element 124 and medial lacing element 125, shortened knit courses may be incorporated into portions of knitted component 134 to form contour sections along curved inner lateral boundary 300, curved outer lateral boundary 304, curved inner medial boundary 302 and/or curved outer medial boundary 306. FIG. 8 schematically depicts knit courses along an exemplary lacing element formed according to techniques described herein. For ease of illustration, the knit courses depicted in FIG. 8 are illustrated in a representative manner and are not shown interlooped or intermeshed with each other. However, it should be understood that adjacent knit courses are connected and interlooped with each other in knitted component 134.

The left portion of FIG. 8 depicts a plurality of knit courses forming an aspect of lateral lacing element 124. Near a top lace aperture 128 depicted in FIG. 8, according to at least one aspect, a first knit course 314 is depicted as extending from outer lateral boundary 304 to inner lateral boundary 300. A second knit course 316 is also depicted as extending from outer lateral boundary 304 to inner lateral boundary 300. Further, lace aperture 128 is disposed between knit course 314 and knit course 316. In some aspects knit course 314 and knit course 316 may terminate at outer lateral boundary 304 and inner lateral boundary 300. In other cases, knit course 314 and knit course 316 may extend beyond outer lateral boundary 304 and/or inner lateral boundary 300.

Also positioned near top lace aperture 128 are shortened knit course 318, shortened knit course 320 and shortened knit course 322 (collectively, contour section 326). In particular, in at least one aspect, shortened knit course 318, shortened knit course 320 and shortened knit course 322 may be positioned between lace aperture 128 and outer lateral boundary 304. In some aspects, shortened knit course 318, shortened knit course 320 and shortened knit course 322 may terminate at outer lateral boundary 304 and lace aperture 128. In other cases, however, shortened knit course 318, shortened knit course 320 and shortened knit course 322 may also extend beyond outer lateral boundary 304.

According to the aspect depicted in FIG. 8, the various knit courses of lateral lacing element 124 may unitarily knit with each other and/or with other knit courses of knitted component 134 to form a knitted component of unitary knit construction. For example, knit course 314 may be interlooped with shortened knit course 318 on a left side of lace aperture 128 and interlooped with knit course 316 on an opposite side of lace aperture 128. Similarly, knit course 316 may be interlooped with shortened knit course 322 on a left side of lace aperture 128 and interlooped with knit course 314 on an opposite side of lace aperture 128. Shortened knit course 320 may be interlooped with both shortened knit course 318 and shortened knit course 322.

Referring to the left side of FIG. 8, lateral lacing element 124 is depicted with straight boundary edges in a stretched-out configuration so that contour section 326, is visible between outer lateral boundary 304 and lace aperture 128. As can be seen in the figure, when in a straightened state as shown in FIG. 8, contour section 326 would appear to create a gap 324 on the opposite side of lace aperture 128 (i.e., between lace aperture 128 and inner lateral boundary 300). However, as seen on curved lacing element 124 on the right side of FIG. 8, because the loops of knit course 314 are interconnected with the loops of knit course 316 toward inner lateral boundary 300, gap 324 effectively goes away and the curved effect may be formed. In other words, where contour section 326 is present on outer lateral boundary 304, convex surface 308 may be created. However, on the opposite inner lateral boundary 300, concave surface 310 may be created. Referring to FIG. 8, it should be understood that gap 324 is representative of the lack of corresponding knit courses during the knitting process, and gap 324 can still include loops connecting opposite courses, for example, knit course 314 and knit course 316, that will span across gap 324.

As may be seen in FIG. 8, to create the curved boundaries or "wavy" undulating appearance of lateral lacing element 124, shortened knit courses may be added as described above along alternating sides of lateral lacing element 124 to produce the alternating convex-to-concave configuration described above. Furthermore, the same technique may be applied on the medial side of knitted component 134 to create medial lacing element 125. The number of shortened knit courses applied along opposite sides of lateral lacing element 124 to produce contour section 326 may be varied to produce a varying amount of curvature along inner lateral boundary 300 and outer lateral boundary 304. Likewise, the number of shortened knit courses applied along opposite sides of medial lacing element 125 may also be varied to produce a varying amount of curvature and along inner medial boundary 302 and outer medial boundary 306. With fewer shortened knit courses, less curvature is produced, and with more shortened knit courses, more curvature is produced. However, with too few shortened knit courses the shape of the lacing element may be only minimally altered and with too many shortened knit courses, the integrity of the entire knitted component may be compromised. In some cases, as few as one shortened knit courses may be added and in other cases, as many as five shortened knit courses may be added. In an exemplary aspect, three shortened knit courses may be added to create an exemplary curvature along lateral lacing element 124 and medial lacing element 125, as well as to ensure the integrity of the entirety of knitted component 134 and the integral lateral and medial lacing elements.

FIG. 8 depicts a consistent number of exemplary shortened knit course extending from a common boundary. For example, along the outer lateral boundary 304, the various contour sections 326 each illustrate an exemplary three shortened knit courses. Similarly, along the inner lateral boundary 300 an exemplary three shortened knit courses are depicted. However, it is contemplated that any number of shortened knit course may form the contoured section(s), in exemplary aspects. Further, it is contemplated that a pattern may be used to achieve a predictable final shape. In an exemplary aspect, an "X"-"Y"-"X"-"Y" pattern of shortened knit courses forming the contour sections may be implemented along a common boundary. In the example, "X" and "Y" may represent any number of shortened knit courses. For example, "X" may be three shortened knit courses and "Y" may be one shortened knit course. In this example, a first in a series of contour sections may be formed from three shortened knit courses, a second contour section in the series may be formed from one shortened knit course, and a third contour section may then be formed from three shortened knit courses. This particular example may provide a particular undulated edge configuration. However, it is contemplated that any sequence of shortened knit course(s) may be implemented to achieve aspects hereof. Further, any pattern, such as "X"-"Y"-"Z"-"X" may be implemented as well.

Method of Forming Exemplary Knitted Components

In some cases, a knitted component may need to be further manipulated after the knitting process to achieve a desired shape and or desired characteristics. In some cases, for example, if fusible yarn is utilized for a knitted component, a heat and/or steam treatment may need to be applied. In other cases, a knitted component may be misshapen after knitting due to inconsistent yarn tensions or the use of varying knit courses, and the shaped of the knitted component may need to be manipulated. According to at least one aspect, knitted component 134 may be treated with steam to manipulate the knitted yarns into a final desired shape.

Figure 10:
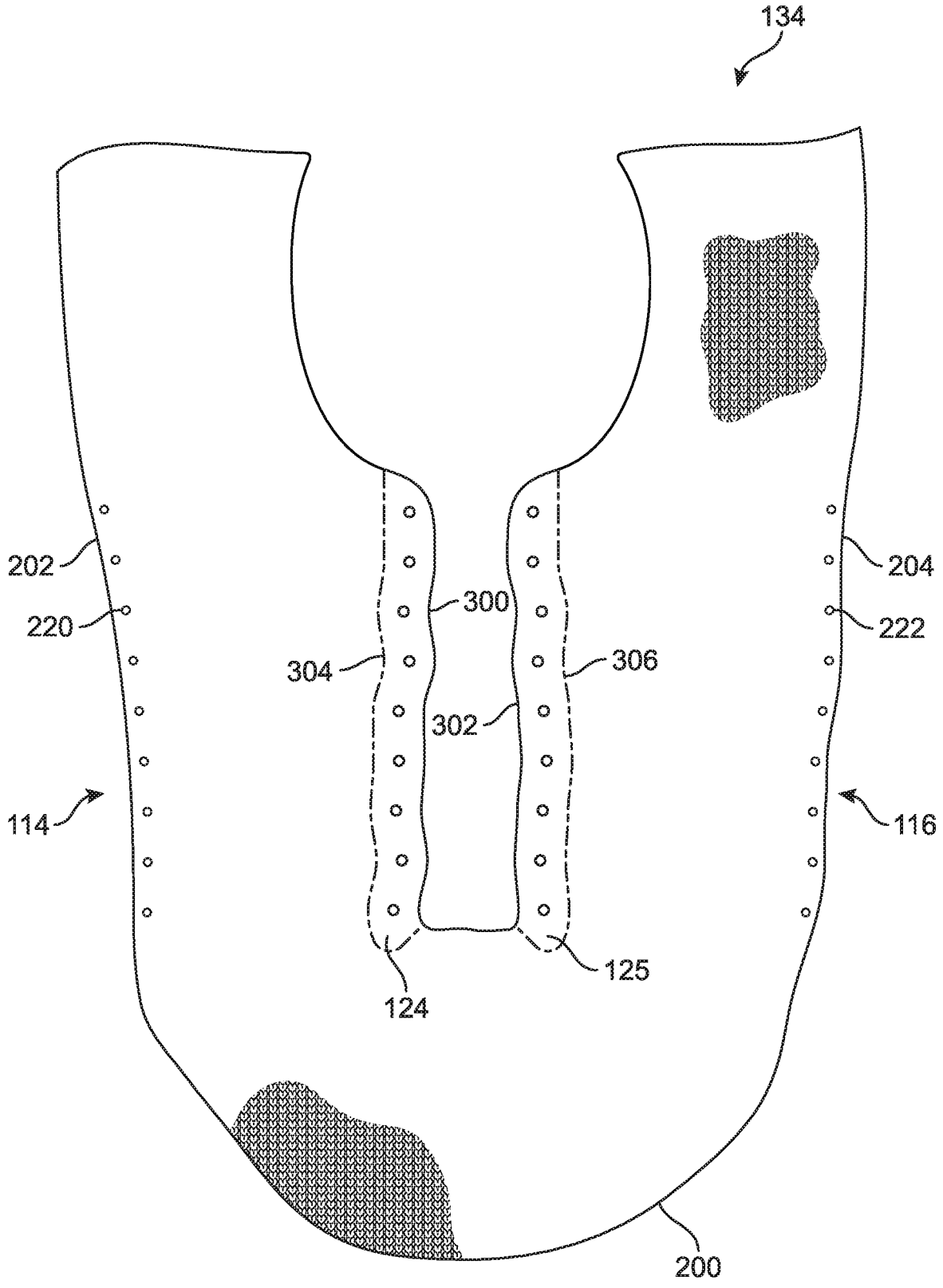
FIG. 10 is an aspect of a knitted component formed according to techniques described herein.

FIG. 10 depicts a representation of how knitted component 134 may appear after the knitting process is complete. Again, to simplify the figure and discussion, tensile element 130 has been omitted from FIG. 10, however, it should be understood that tensile element 130 may be incorporated using the same process and techniques described herein. As shown in FIG. 10, after knitting, knitted component 134 may lack the desired shape, structure and characteristics for incorporation into upper 104 and, ultimately, article 100. For example, outer perimeter edge 200 may be inconsistent, smaller and/or larger than desired, or misshapen. In addition, lateral lacing element 124 and medial lacing element 125, while incorporating the shortened knit courses as described herein, may exhibit inconsistent courses and boundaries.

According to techniques described herein, the shape and configuration of knitted component 134 may be manipulated after knitting. In some cases, knitted component 134 may be stretched using a rigid shaping mechanism to force knitted component 134 into a predefined shape. In other cases, heat and/or steam may be applied to knitted component 134 to allow the yarns to expand and/or contract to the desired shape. In at least one exemplary aspect, knitted component 134 may be fitted on a rigid positioning element and subjected to thermal energy, such as water-based steam, to effect a proper configuration or the desired shape of the knitted component.

Figure 11:
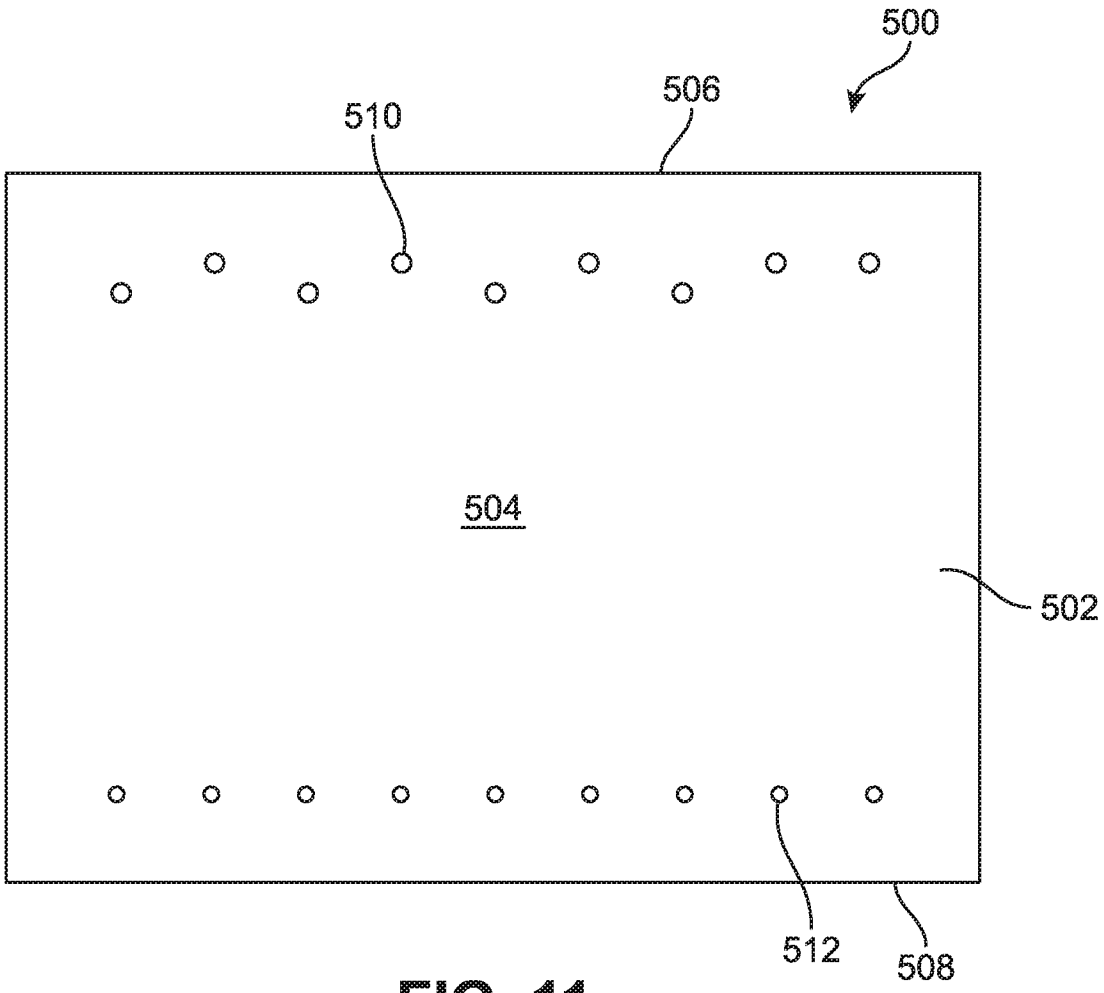
FIG. 11 is a top view of an aspect of a positioning element, in accordance with aspects hereof.
Figure 12:
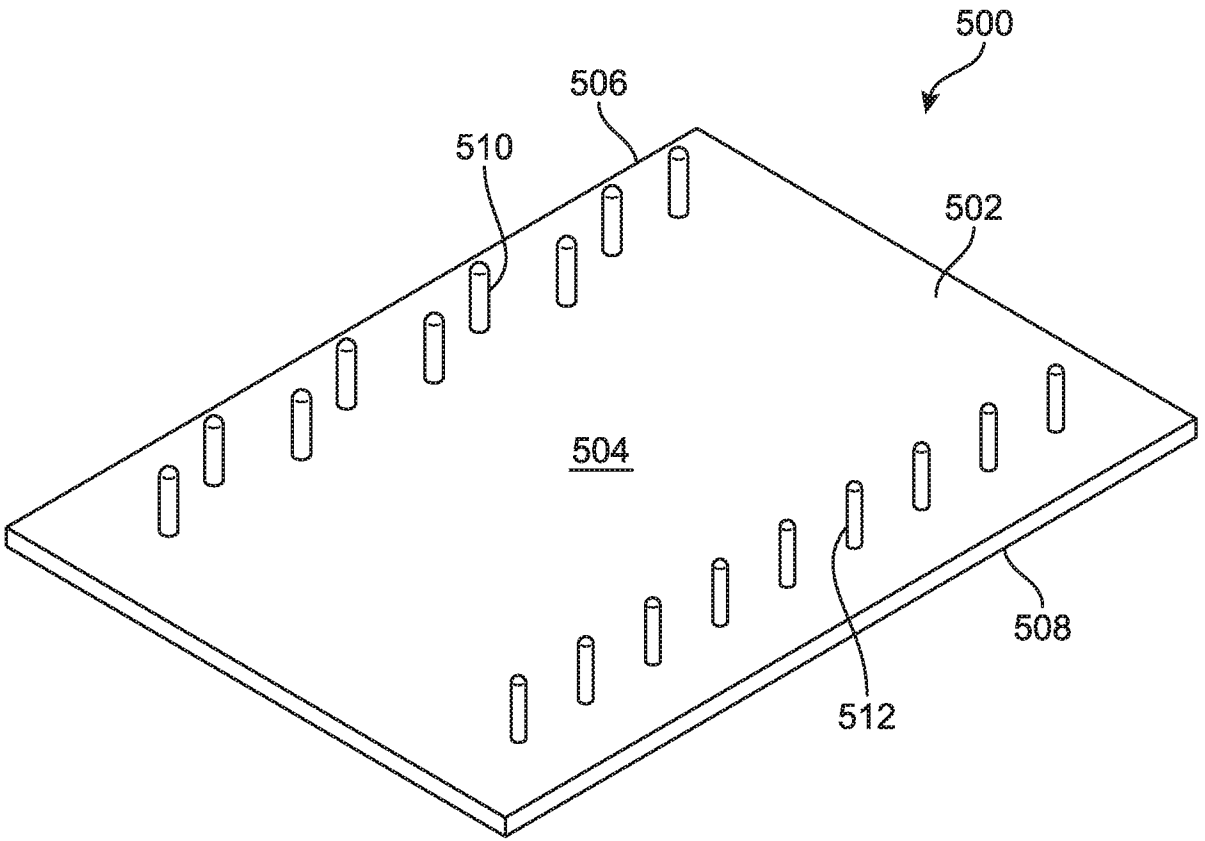
FIG. 12 is an isometric view of the positioning element aspect of FIG. 11.

FIGS. 11 and 12 depict an exemplary rigid positioning element 500 according to at least one aspect described herein. According to aspects hereof, positioning element 500 may include plate 502 having top side 504 and a bottom side (not shown). In at least one aspect, plate 502 may comprise a rectangular shape so as to position on either a lateral side or a medial side of a knitted component 134. However, plate 502 may be configured in many different shapes, or sized to fit a particular knitted component, and still serve the purpose for which it is intended. As seen in FIGS. 11 and 12, along its longer edges, plate 502 may include an inner edge 506 and an outer edge 508. Spaced slightly inward from inner edge 506, positioning element 500 may include a plurality of lace aperture positioning elements 510. Lace aperture positioning elements 510 may be spaced and configured to engage with the plurality of lace apertures 128 of the lacing elements on knitted component 134 for shaping. Positioning element 500 may also include a plurality of knitted component edge positioning elements 512 that are spaced slightly inward from outer edge 508. Knitted component edge positioning elements 512 may be spaced and configured to engage with a plurality of knitted component apertures, such as lateral positioning apertures 220 and medial positioning apertures 222, shown in FIG. 10.

Figure 13:
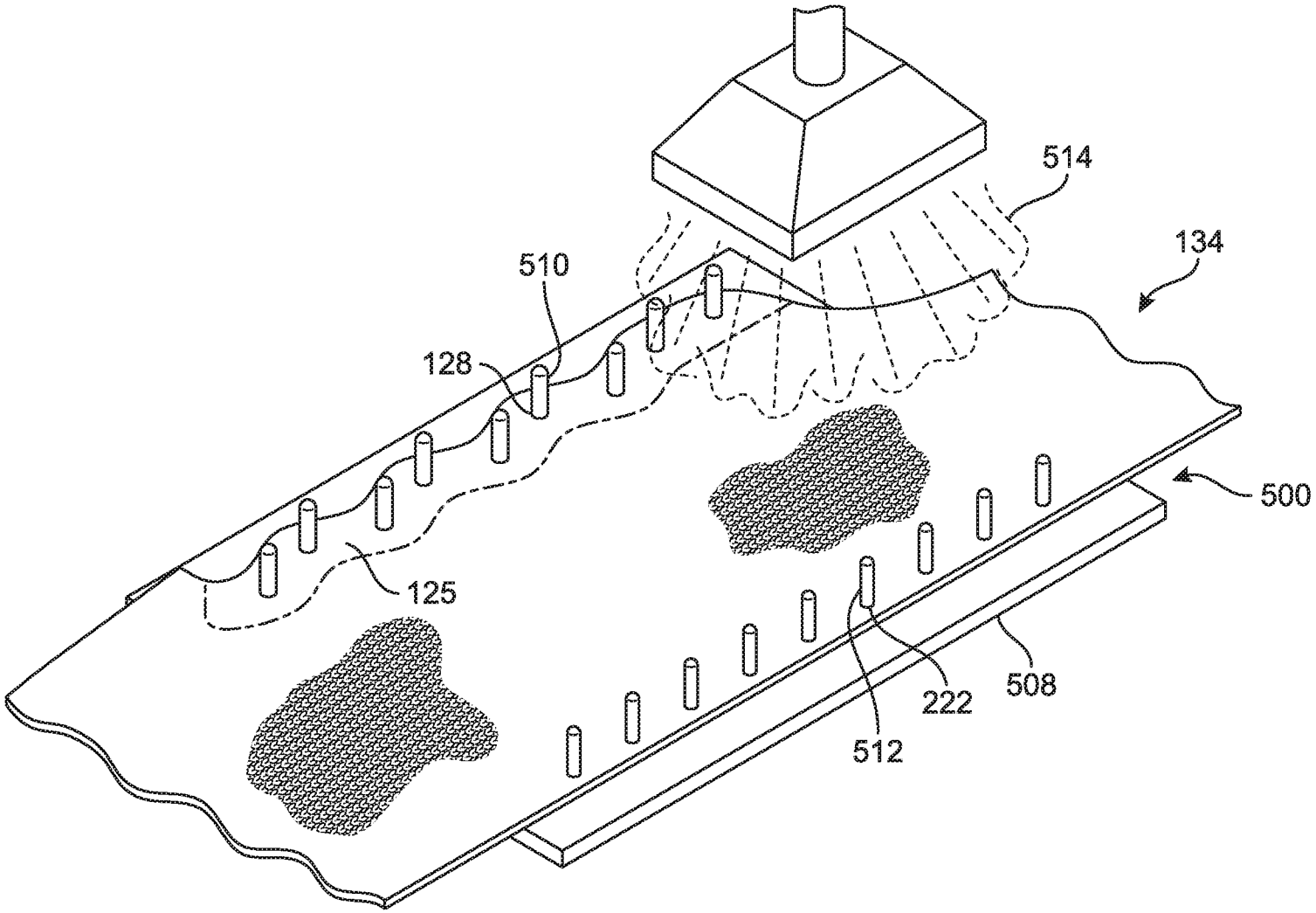
FIG. 13 is an isometric view of a knitted component engaged with a positioning element, according to techniques described herein.

FIG. 13 depicts the process of manipulating a medial portion 116 of knitted component 134 using positioning element 500 and steam 514. According to aspects described herein, after knitting is complete for knitted component 134, positioning element 500 may be used to further configure the shape of knitted component 134, including lateral lacing element 124 and medial lacing element 125. In particular, as depicted in FIG. 13, a medial side portion of knitted component 134 is shown fitted on positioning element 500. First, medial positioning apertures 222 may be fitted over knitted component edge positioning elements 512 and lace apertures 128 may be fitted over lace aperture positioning elements 510. After positioning, steam 514 may be applied to knitted component 134 to shrink and or compress the yarn into a desired shape. The same process may be used to manipulate lateral portion 114 of knitted component 134.

Figure 14:
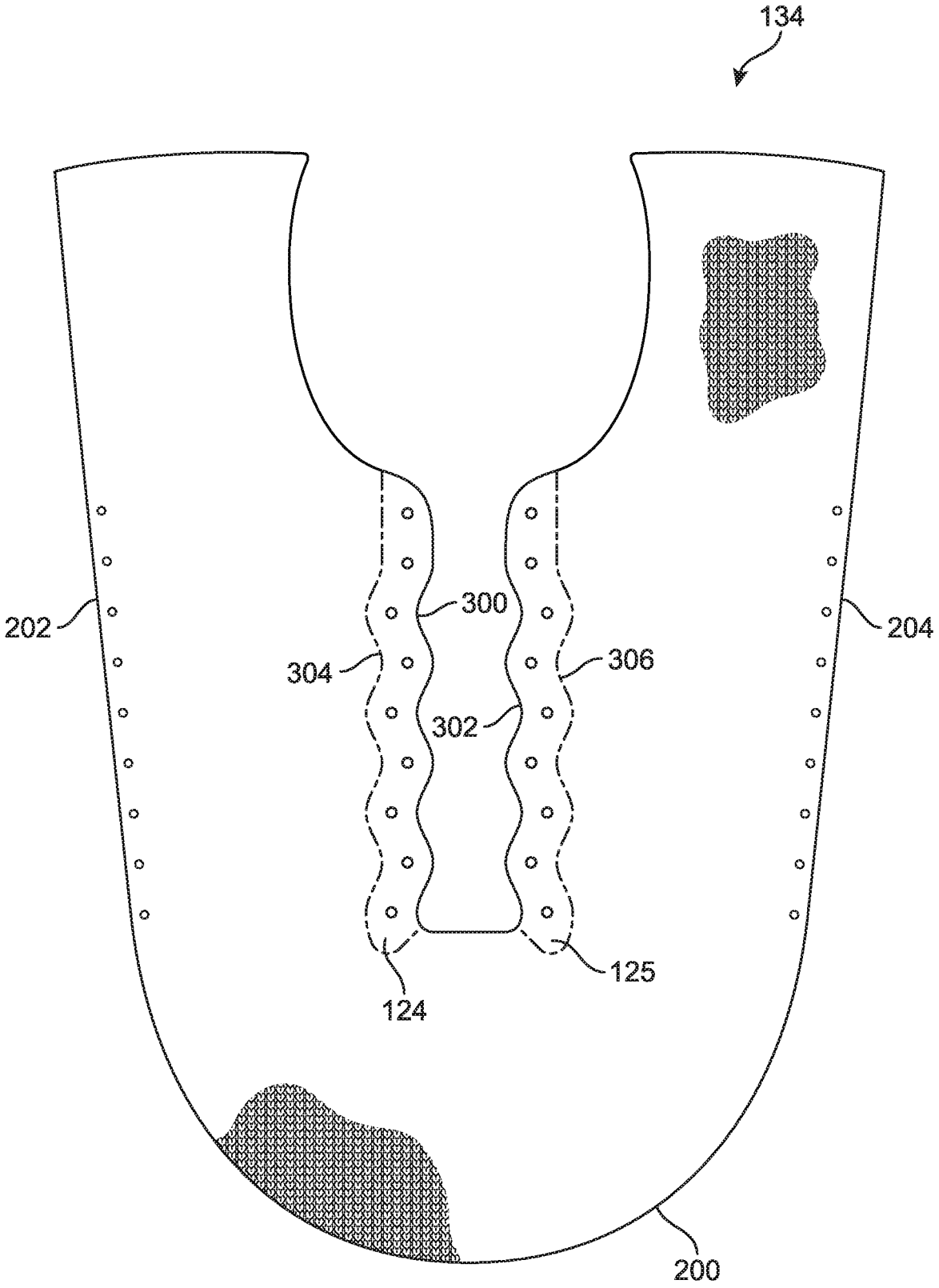
FIG. 14 is an aspect of the knitted component depicted in FIGS. 9 and 13, formed according to techniques described herein.

FIG. 14 depicts knitted component 134 after being manipulated with steam, such as on positioning element 500. Compared with the pre-manipulated knitted component 134 depicted in FIG. 10, the knitted component of FIG. 14 depicts a rounded and consistent outer perimeter edge 200 as well as a curved lateral lacing element 124 and medial lacing element 125, both exhibiting "wavy" undulating boundaries with offset lace apertures 128. As can be seen in knitted component 134 depicted in FIG. 14 after steaming, the curved boundaries of lateral lacing element 124 and medial lacing element 125 are balanced along the entirety of inner lateral boundary 300, outer lateral boundary 304, inner medial boundary 302 and outer medial boundary 306.

Further, once the shape of knitted component 134 has been finalized, it may be desirable to further reinforce the shape to create integrity and to prevent the shape and dimensions from deforming over time. For example, in some cases, a facing or backing material may be cut to the same size and shape as knitted component 134 to be sewn, glued or otherwise affixed to a back surface of knitted component 134. In other cases, a heat fusible backing may be applied to knitted component 134. As provided herein, a TPU backing may be applied to one or more portions of the knitted component 134. In still other cases, where heat-fusible yarn is utilized for knitting, the yarn itself may be partially or fully fused together with heat. In addition, other reinforcements known in the art may also be applied to knitted component 134 and still fall within the scope of the present disclosure.

Figure 18:
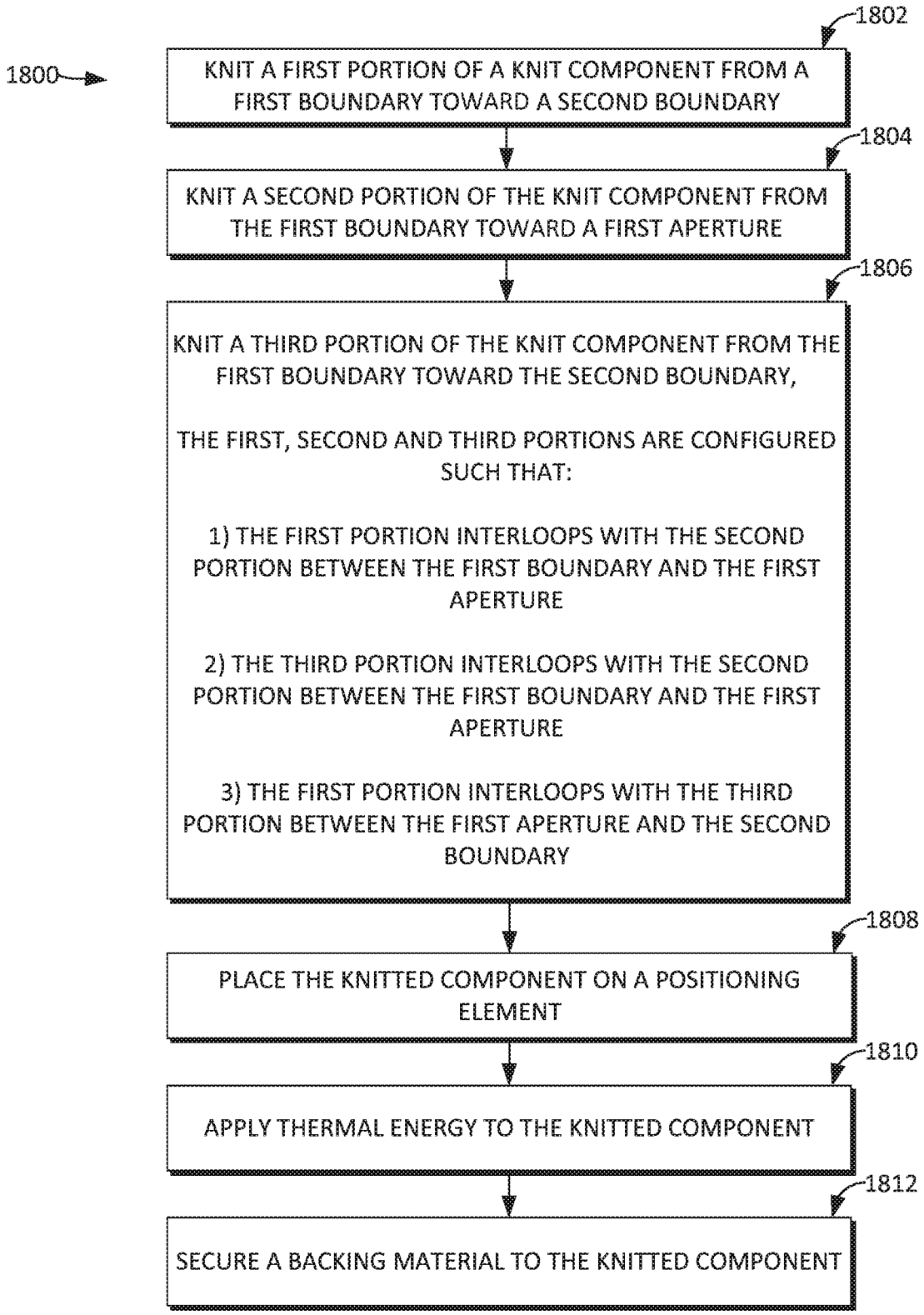
FIG. 18 is a block diagram representing an exemplary method of forming an upper of an article of footwear having a knitted component, in accordance with exemplary aspects hereof.

FIG. 18 depicts a flow chart 1800 for an exemplary method of forming an upper of an article of footwear having a knitted component, in accordance with exemplary aspects hereof. The method begins at a block 1802 that represents knitting a first portion of a knit component from a first boundary toward a second boundary. As provided hereinabove, a boundary may be a termination edge of the knit component, a transitional boundary from a first knitting technique to a second knitting technique and/or a location within the knit component. Further, the term "toward" is used in the detailed description and claims to provide a general direction without requiring extending all of the way to the boundary. Therefore, the first portion extends towards a second boundary, where the first portion may not extend all of the way to the second boundary and the second boundary may be an edge, a transition, and/or a location, in exemplary aspects. For illustration purposes, the first portion listed in the block 1802 may be illustrated as the first knit course 314 of FIG. 8 discussed hereinabove, in an exemplary aspect. The first knit portion may be any material, including a fuseable yarn, in an exemplary aspect.

At a block 1804, a step is illustrated for knitting a second portion of the knit component from the first boundary toward the first aperture. In an exemplary aspect, the second portion is comprised of at least one course. As such, it is contemplated that any number of courses may be implemented, such as three in an exemplary aspect. The second portion is interlooped with the first portion between the first boundary and the first aperture. In an exemplary aspect, the first portion and the second portion are of a unitary knit construction. The second portion may be referred to as a shortened knit course, such as the shortened knit course 318, 319, or 320 of FIG. 8 discussed hereinabove, for example. Further, it is contemplated that the second portion of block 1804 may also be referred to as a contour section, such as contour section 326 of FIG. 8 discussed hereinabove, in an exemplary aspect.

At a block 1806, a step is illustrated for knitting a third portion of the knit component from the first boundary toward the second boundary. In an exemplary aspect, the third portion is comprised of at least one course. It is contemplated that any number of courses may be implemented. In an exemplary aspect, the third portion is interlooped with the second portion between the first boundary and the first aperture. Continuing with this exemplary aspect, it is contemplated that the third portion is also interloped with the first portion between the first aperture and the second boundary. For illustrative purposes, the third portion of block 1806 may be depicted as the second knit course 316 of FIG. 8 discussed hereinabove. In an exemplary aspect, the first, second, and third portions of blocks 1802, 1804, and 1806 are formed as a unitary knit construction.

A block 1808, which may be optional in exemplary aspects, illustrates a step is illustrated for placing the knitted component on a positioning element. The positioning element may be similar to the positioning element 500 of FIG. 12 discussed hereinabove, for example. Similar to the depiction of FIG. 13, the step of block 1808 contemplates positioning the first aperture relative to a plate of the positioning element such that a first lace aperture positioning element that is affixed to the plate extends through the first aperture, as is illustrated in FIG. 13 with the lace aperture positioning element 510 extending through lace aperture 128, in an exemplary aspect.

A block 1810, which may be optional in exemplary aspects, illustrates a step of applying thermal energy to the knitted component. In an exemplary aspect, the thermal energy is water-based steam. The knitted component may be releasably secured to the positioning element of block 1808 when the thermal energy is applied. Alternatively, the knit component is not secured to the positioning element when the thermal energy is applied. The thermal energy, as discussed with respect to FIG. 13 hereinabove, may cause one or more materials of the knit component to contract, constrict, or otherwise shrink, in exemplary aspects. Further, it is contemplated that a material of the knit component may fuse (e.g., mechanically and/or chemically bond) to another material of the knit component as a result of the application of thermal energy. This thermal energy application may help shape and size the knit component as well as to "lock" the size/shape of the knit component, in aspects.

At a block 1812, which may be optional in exemplary aspects, illustrates a step of securing a backing material to the knitted component. In an exemplary aspect, the backing material is a TPU that is secure by adhering the TPU with at least a portion of the knit component. For example, an interior surface of the knitted component that faces the interior cavity of an article of footwear (e.g., interior surface 138 of FIG. 1) may have the backing secured thereto. Further, it is contemplated that at least the first portion, the second portion, and the third portion have the backing affixed thereto, in an exemplary aspect. The back may be pressure and/or heat secured to the knit component. For example, the application of thermal energy at block 1810 may be effective, in an exemplary aspect, the secure the backing to the knit component, such as when the backing is a TPU or other hot-melt-adhesive-containing material.

Additional Exemplary Aspects

In some cases, a lacing element may be knitted and attached to a separately formed upper. FIG. 15 depicts an exploded view of an aspect of an article of footwear 600 having a separately formed lateral lacing element 624 and medial lacing element 625, each having a plurality of lace apertures 628. FIG. 16, depicts article 600 with lateral lacing element 624 and medial lacing element 625 attached to upper 604 along lateral edge 608 and medial edge 610. Further, in at least one aspect, both lateral lacing element 624 and medial lacing element 625 form curved inner and outer boundaries and lace apertures 628 may be offset from each other in the vertical direction with respect to the formed upper 604 of article 600.

Similar to previously discussed aspects, article 600 includes an upper 604 with a lateral side 614 and a medial side (not shown). Upper 604 is attached to sole structure 602. Along a throat region, upper 604 may include a lateral edge 608 and a medial edge 610, configured so that separately formed lateral lacing element 624 and medial lacing element 625 may be attached thereto. Upper 604 may be formed according to techniques known in the art. For example, in some cases, upper 604 may incorporate materials such as leather or polymers. In other cases, upper 604 may comprise a separately formed knitted component. Upper 604 may also include tensile elements or other structure features that are integrally formed with upper 604 (similar to previously discussed aspects) or otherwise attached to upper 604. Those skilled in the art will appreciate the full range of materials and configurations of separately formed upper 604, and will understand that upper 604 is not limited by only those materials and configurations discussed herein.

Similar to previously discussed aspects, lateral lacing element 624 and medial lacing element 625 may be configured to distribute tension along upper 604. For example, in some aspects, lateral lacing element 624 and medial lacing element 625 may have an offset boundary to facilitate offset placement of the lace apertures. In some cases, lateral lacing element 624 may include curved inner lateral boundary 612 and curved outer lateral boundary 616, and a vertically offset lace apertures 628. Similarly, medial lacing element 625 may also include curved inner medial boundary 614 and curved outer medial boundary 618, and vertically offset lace apertures 628. Further, in at least one case, each curved boundary of lateral lacing element 624 and medial lacing element 625 may alternate between a convex and concave orientation so that each lacing element has a "wavy" appearance. For example, referring to the aspect of FIG. 15, as curved outer lateral boundary 616 forms a convex surface, curved inner lateral boundary 612 forms an opposite concave surface. This convex-to-concave orientation may continue along the length of curved inner lateral boundary 612 and curved outer lateral boundary 616. The same convex-to-concave orientation may also be present along the length of curved inner medial boundary 614 and curved outer medial boundary 618.

Lateral lacing element 624 and medial lacing element 625 may be formed on a standard flat knitting machine, such as knitting machine 400, in the same way as described above for lateral lacing element 124, and medial lacing element 125, as well as knitted component 134. In particular, lateral lacing element 624 and medial lacing element 625 may be formed by incorporating shortened knit courses in a contour section in the same way as described in relation to FIG. 8. Further, the final shape of both lateral lacing element 624 and medial lacing element 625 may be manipulated with a positioning plate and steam, in the same was as described in relation to prior aspects, referring to FIGS. 11-13. In addition, similar to aspects discussed above, once the shape of lateral lacing element 624 and medial lacing element 625 has been finalized, the lacing elements may be reinforced to add additional strength and integrity to the knit elements. For example, in some cases, a facing may be cut to the same size and shape as lateral lacing element 624 and medial lacing element 625 and can be sewn, glued or otherwise affixed to the back surfaces of the lacing elements. In other cases, where heat-fusible yarn is utilized in knitting lateral lacing element 624 and medial lacing element 625, heat may be applied to partially fuse the structure of the knitted elements.

Lateral lacing element 624 and medial lacing element 625 may be attached to the separately formed upper 604 using a variety of techniques known in the art. In particular, lacing element 624 may be glued or sewn to upper 604. In other aspects, lacing element 624 may be fused to upper 604 using heat. As shown in the magnified portion of FIG. 16, lateral lacing element 624 is attached to the remainder of upper 604 by stitching 630. Specifically, lateral lacing element 624 may be stitched along the entirety of curved outer lateral boundary 616 to affix lateral lacing element 624 to upper 604. Medial lacing element 625 may be stitched along curved outer medial boundary 618 in a similar fashion. However, it should be understood that lateral lacing element 624 and medial lacing element 625 may be affixed in still other ways that would be known and contemplated by those skilled in the art.

Figure 17:
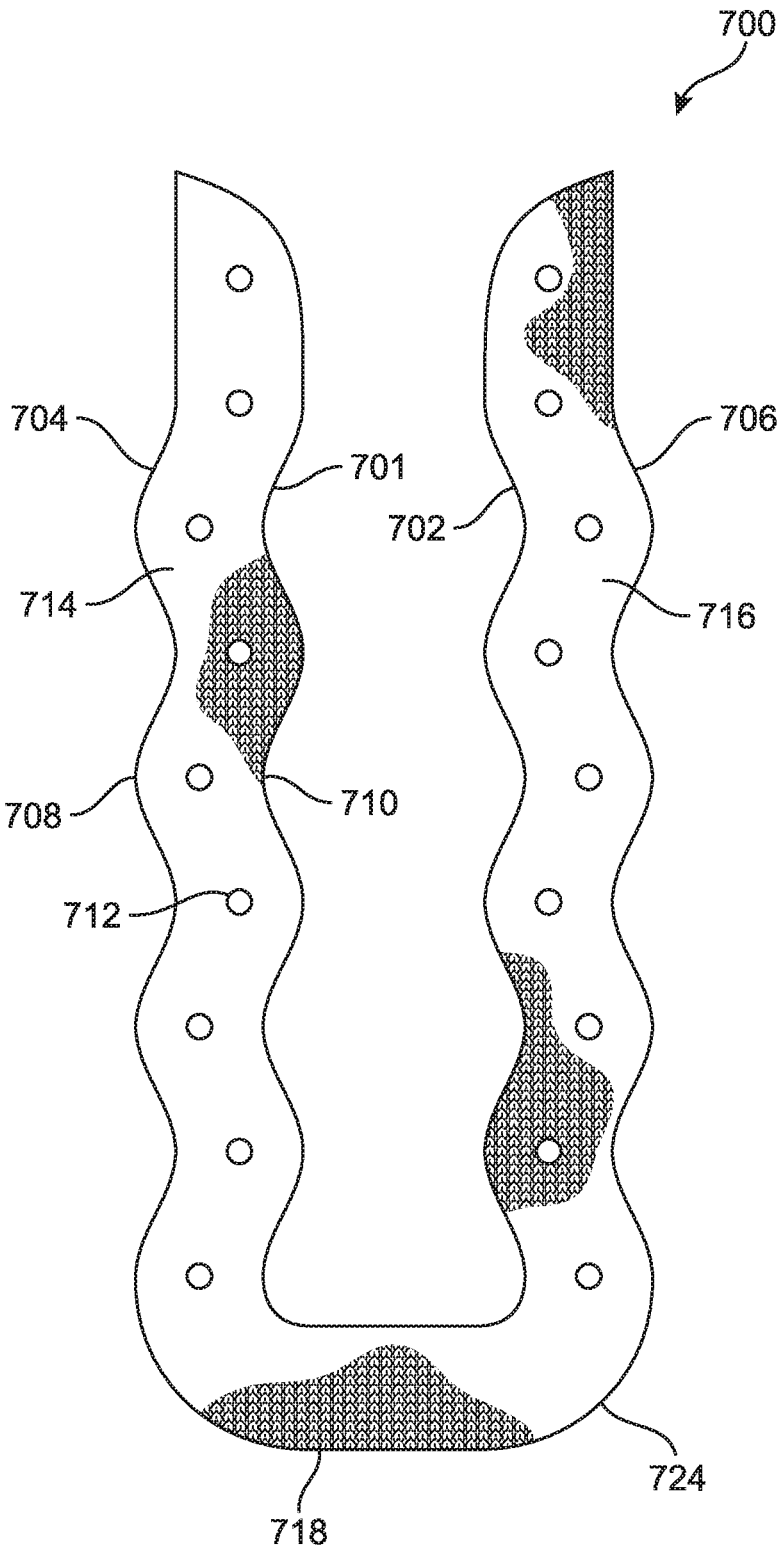
FIG. 17 is a top view of another aspect of a knitted component formed according to aspects described herein.

Referring to FIG. 17, in another aspect, lacing element 724 may comprise a separately formed knitted component 700 having a u-shaped configuration with curved interior and exterior boundaries. In particular, similar to previously discussed lacing element 124, lacing element 724 may include lateral portion 714 having curved inner lateral boundary 701 and curved outer lateral boundary 704, medial portion 716 having curved inner medial boundary 702 and curved outer medial boundary 706, and forefoot portion 718. Similar to prior aspects, each curved boundary of lacing element 724 may alternate between a convex and concave orientation so that each side of the u-shape has a "wavy" appearance. For example, as curved outer lateral boundary 704 forms a convex surface 708 (i.e., convex toward outer lateral boundary 704), curved inner lateral boundary 701 forms a concave surface 710 (i.e., concave toward outer lateral boundary 704). This convex-to-concave orientation continues along curved inner lateral boundary 701, curved inner medial boundary 702, curved outer lateral boundary 704 and curved outer medial boundary 706.

Similar to previously discussed aspects, curved lacing element 724 may be formed on a standard flat knitting machine, such as knitting machine 400. In particular, to form curved lacing element 724, shortened knit courses may be incorporated into portions of knitted component 700 as described in relation to FIG. 8. In addition, the shape of knitted component 700 may be manipulated with a positioning plate and steam, in the same was as described in relation to prior aspects, referring to FIGS. 11-13.

Further, similar to aspects discussed above, once the shape of knitted component 700, and lacing element 724 has been finalized, lacing element 724 may also be reinforced as previously described. For example, in some cases, a facing may be cut to the same size and shape as lacing element 724 and can be sewn, glued or otherwise affixed to a back surface of lacing element 724. In other cases, where heat-fusible yarn is utilized in knitting of the knitted component 700, heat may be applied to partially fuse the structure of knitted component 700.

Lacing element 724 may be attached to a separately formed upper as described above in relation to lateral lacing element 624 and medial lacing element 625. In particular, lacing element 724 may be glued or sewn to upper 604. In other aspects, lacing element 724 may be fused to upper 604 using heat. In addition, lacing element 724 may be formed as a unitary knit article with a full knitted component, such as described above in relation to the knitted component 134.

Knitting Machine Configuration

Figure 9:
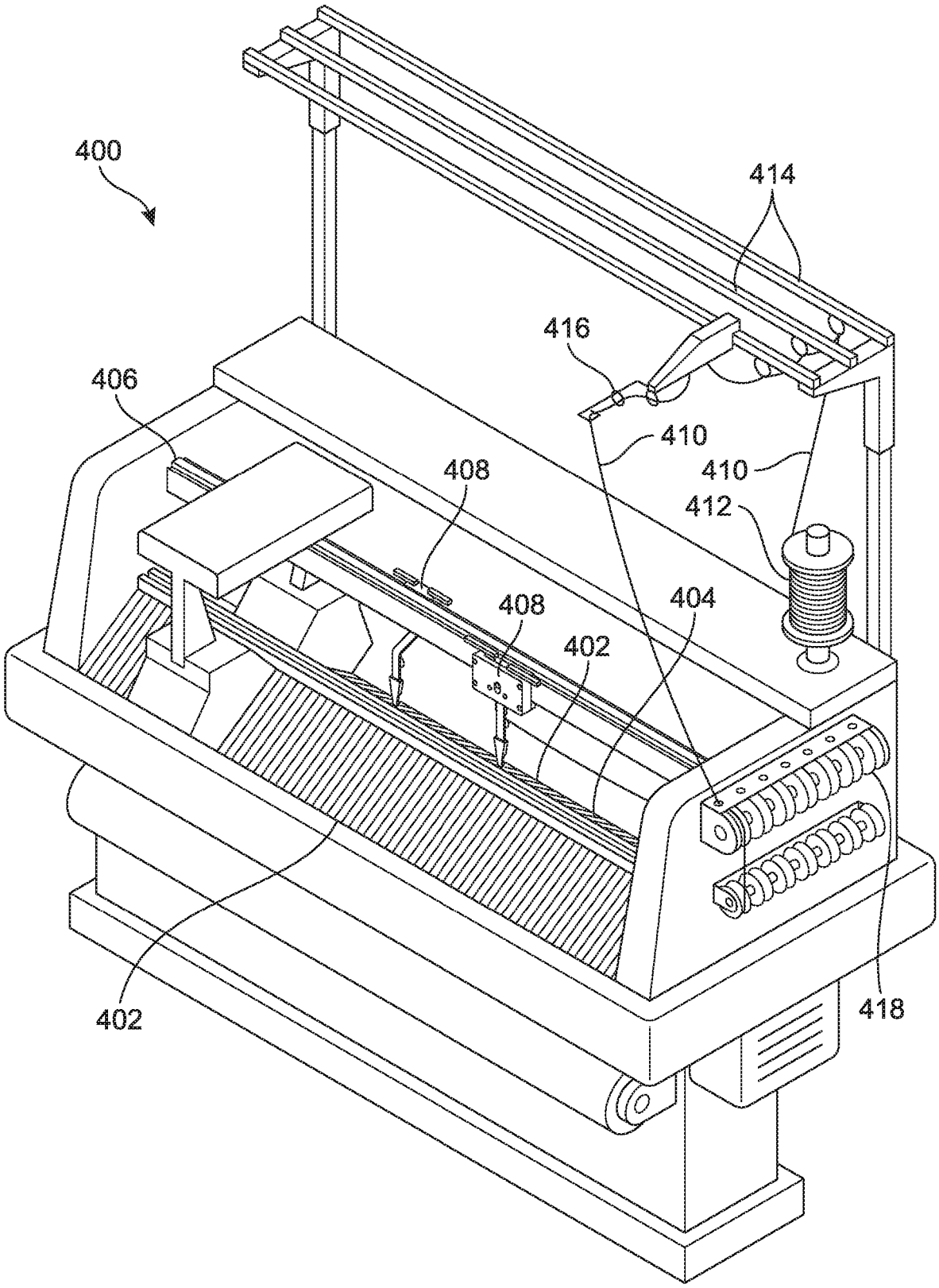
FIG. 9 is an isometric view of an exemplary knitting machine.

Although knitting may be performed by hand, commercial manufacturing of knitted components is generally performed by knitting machines. An example of a knitting machine capable of producing a knitted component, such as knitted component 134 described herein, is depicted in FIG. 9. Knitting machine 400 is configured as a v-bed flat knitting machine; however, other types of knitting machines may be suitable for construction of the knitted component. For example, a flatbed flat knitting machine may also be utilized in some instances. Knitting machines that may be used for knitting a knitted component according to the principles described herein include knitting machines manufactured by Stoll, Shima Seiki, as well as other knitting machine manufacturers that have the capabilities to produce a knitted component in accordance with the teachings detailed in this description.

In some aspects, knitting machine 400 may include two needle beds 402. In some cases, needle beds 402 may be angled thereby forming a v-bed. Each needle bed 402 contains a plurality of individual needles 404 that lay on a common plane. That is, needles 404 of one needle bed 402 lie in one plane while needles 404 of the other needle bed 402 lie in a different plane. The first plane and second plane are angled such that the intersection of the planes extends along a majority of the width of the knitting machine 400. As described in further detail below, needles 404 may have a first position where they are retracted, a second position where they are extended, and a third position where they are partially extended. In the first position the needles are spaced from the intersection point. In the second position the needles may pass through the intersection point. In the third position the needles are located between the first position and the second position.

A rail 406 extends above and parallel to the intersection of needle beds 402. The rail may provide attachment points for feeders 408. The feeders 408 may supply yarn 410 to needles 404 in order for the needles 404 to manipulate yarn 410. Due to the action of a carriage, feeders 408 may move along the rail 406 and needle bed 402, thereby supplying yarn 410 to needles 404. In FIG. 9, a yarn 410 is provided to feeder 408 by a spool 412. More particularly, yarn 410 extends from spool 412 to various yarn guides 414, a yarn take-back spring 416 and a yarn tensioner 418. The feeder 408 has the ability to supply a yarn that needles 404 may manipulate to knit, tuck and float. Some machines may have multiple spools from which feeder 408 may receive yarn 410. The multiple yarns may be utilized in the knit structure.

Knitting machine 400 may operate to manufacture knitted component 134. More particularly, needles 402 pull sections of yarn 410 fed by feeder 408 through loops of a prior course, thereby forming another course of knitted component 134. It should be understood that the general structure of knitting machine 400 is simplified for purposes of explaining knitted component 134 as well as the method of forming knitted component 134. In addition, the knit courses for knitted component 134 are depicted in the figures as separate yarns, i.e., the yarn courses are not depicted as being looped together through prior course. However, those skilled in the art will readily understand that the figures have been simplified for discussion purposes and will appreciate that to effectuate knitted component 134, yarn courses will be looped together to form a series of courses and wales.

While various aspects have been described, the description is intended to be exemplary, rather than limiting and it will be apparent to those of ordinary skill in the art that many more aspects and implementations are possible that are within the scope of the aspects. For example, in addition to footwear, the knitted components may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes, and the aspects are not to be restricted except in light of the attached claims and their equivalents. Also, various modifications and changes may be made within the scope of the attached claims.

I claim:

1. A knitted component, comprising:

a boundary;

a first course extending from the boundary; and a second course extending from the boundary, wherein the first course and the second course are interlooped at a first location, the first location being adjacent to the boundary, wherein a contour section is located between the first course and the second course at a second location, the second location being spaced from the boundary, such that the boundary is curved in a concave manner at the first location, and wherein a second boundary is curved in a convex manner at the second location.

2. The knitted component of claim 1, wherein the contour section includes a third course that is interlooped with at least one of the first course and the second course, the third course terminating at a location between the first location and the second location.

3. The knitted component of claim 1, wherein an aperture is located between the first course and the second course, the aperture being adjacent to the contour section, and the aperture being located between the first location and the second location.

4. The knitted component of claim 3, wherein the contour section includes a third course being interlooped with at least one of the first course and the second course, the third course terminating at the aperture.

5. The knitted component of claim 3, further comprising a second aperture, wherein the boundary is curved in a convex manner at a location adjacent to the second aperture.

6. The knitted component of claim 1, wherein the second boundary is adjacent to the second location.

7. The knitted component of claim 6, wherein a third course extends from the second location at the second boundary, wherein the third course is interlooped with at least one of the first course and the second course, and wherein the third course is located between the first course and the second course.

8. The knitted component of claim 1, wherein a third location located adjacent to the boundary includes a second contour section such that the boundary curves in a convex manner at the third location.

9. The knitted component of claim 1, wherein the knitted component forms a lacing element for an upper of an article of footwear.

10. A knitted component, comprising:

a boundary; and a first course extending from the boundary; and a second course extending from the boundary, wherein a contour section is located between the first course and the second course at a first location, the first location being adjacent to the boundary, such that the boundary is curved in a convex manner at the first location, wherein the first course and the second course are interlooped at a second location, the second location being spaced from the boundary, and wherein a second boundary is curved in a concave manner at the second location.

11. The knitted component of claim 10, wherein the contour section includes a third course that is interlooped with at least one of the first course and the second course, the third course terminating at a location between the first location and the second location.

12. The knitted component of claim 10, wherein an aperture is located between the first course and the second course, the aperture being adjacent to the contour section, and the aperture being located between the first location and the second location.

13. The knitted component of claim 12, wherein the contour section includes a third course being interlooped with at least one of the first course and the second course, the third course terminating at the aperture.

14. The knitted component of claim 12, further comprising a second aperture, wherein the boundary is curved in a concave manner at a location adjacent to the second aperture.

15. The knitted component of claim 10, wherein the second boundary is adjacent to the second location.

16. The knitted component of claim 15, wherein a third course extends from the first location at the boundary, wherein the third course is interlooped with at least one of the first course and the second course, and wherein the third course is located between the first course and the second course.

17. The knitted component of claim 10, wherein the knitted component forms a lacing element for an upper of an article of footwear.

18. A knitted component, comprising:

a first boundary and a second boundary;

a first aperture and a second aperture, wherein each of the first aperture and the second aperture is located between the first boundary and the second boundary;

a first location and a second location adjacent to the first aperture, wherein the first location is located adjacent to the first boundary, wherein the second location is located adjacent to the second boundary, wherein the first boundary is curved in a concave manner at the first location, and wherein the second boundary is curved in a convex manner at the second location; and a third location and a fourth location adjacent to the second aperture, wherein the third location is located adjacent to the first boundary, wherein the fourth location is located adjacent to the second boundary, wherein the first boundary is curved in a convex manner at the third location, and wherein the second boundary is curved in a concave manner at the fourth location.

19. The knitted component of claim 18, wherein a first contour section is located at the second location, and wherein a second contour section is located at the third location.

20. The knitted component of claim 19, wherein the first and second contour sections each include at least one shortened course that terminates at the first aperture and the second aperture, respectively.

* * * * *